US011648786B2

(12) United States Patent
Yamaguchi

(10) Patent No.: US 11,648,786 B2
(45) Date of Patent: May 16, 2023

(54) RECORDING DEVICE AND METHOD FOR REVERSELY TRANSPORTING RECORDING MEDIUM

(71) Applicant: Seiko Epson Corporation, Tokyo (JP)

(72) Inventor: Kenji Yamaguchi, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 1 day.

(21) Appl. No.: 17/387,681

(22) Filed: Jul. 28, 2021

(65) Prior Publication Data

US 2022/0032663 A1 Feb. 3, 2022

(30) Foreign Application Priority Data

Jul. 31, 2020 (JP) ..... JP2020-130388

(51) Int. Cl.
*B41J 29/17* (2006.01)
*B41J 13/08* (2006.01)
*B41J 13/00* (2006.01)

(52) U.S. Cl.
CPC ..... *B41J 13/0045* (2013.01); *B41J 13/08* (2013.01); *B41J 29/17* (2013.01)

(58) Field of Classification Search
CPC ..... B41J 29/17; B41J 13/08; B41J 11/007
See application file for complete search history.

(56) References Cited

U.S. PATENT DOCUMENTS

2011/0234662 A1* 9/2011 Tsuchiya ..... B41J 11/0015 347/9

FOREIGN PATENT DOCUMENTS

EP 2907668 A1 * 8/2015 ..... B41J 11/007
JP 2012-116093 6/2012
JP 2020032664 A * 3/2020 ..... B41J 29/17

OTHER PUBLICATIONS

Onishi, MachineTranslationofJP-2020032664-A, 2020 (Year: 2020).*

* cited by examiner

*Primary Examiner* — Scott A Richmond
(74) *Attorney, Agent, or Firm* — Workman Nydegger

(57) ABSTRACT

A recording device includes an endless transporting belt that transports a recording medium in a normal transport direction and a reverse transport direction, a recording head, a cleaning liquid attaching unit that attaches a cleaning liquid to a front surface of the transporting belt, a first blade that comes into contact with the front surface to remove the cleaning liquid attached to the front surface, and a blade moving unit that moves the first blade in approaching and separating directions with respect to the front surface. The blade moving unit causes the first blade to come into contact with the front surface when the transporting belt is rotating in a reverse rotation direction, and causes the first blade to be separated from the front surface when the transporting belt is rotating in a normal rotation direction.

8 Claims, 14 Drawing Sheets

RECORDING DEVICE AND METHOD FOR REVERSELY TRANSPORTING RECORDING MEDIUM

The present application is based on, and claims priority from JP Application Serial Number 2020-130388, filed Jul. 31, 2020, the disclosure of which is hereby incorporated by reference herein in its entirety.

BACKGROUND

1. Technical Field

The present disclosure relates to a recording device and a method for reversely transporting a recording medium.

2. Related Art

Various recording devices have been used. Of these, a recording device is known that includes a transporting belt that transports a recording medium, a recording head that ejects ink onto the transported recording medium to perform recording, and a cleaning unit that cleans the transporting belt. For example, in JP-A-2012-116093, an inkjet recording device is disclosed that includes a transporting belt, a recording head that ejects ink onto a transported recording medium, and a cleaning liquid attaching unit that cleans the transporting belt.

In a recording device provided with a transporting belt and a recording head, reverse transportation may be performed in which a recording medium is transported in the opposite direction to a direction of a normal recording operation. However, in a configuration provided with a cleaning unit that cleans the transporting belt, such as the inkjet recording device disclosed in JP-A-2012-116093, a case occurs in which a cleaning liquid used by the cleaning unit remains on a front surface of the transporting belt, and as a result of transporting the recording medium in the reverse direction, the cleaning liquid remaining on the surface of the transporting belt becomes attached to the recording medium.

Here, in the inkjet recording device disclosed in JP-A-2012-116093, the adhesion of the cleaning liquid onto the recording medium as a result of transporting the recording medium in the reverse direction is suppressed based on a relationship between an inter-nozzle distance of the recording head in a transport direction of the recording medium and a distance from a peeling position of the recording medium to the cleaning liquid attaching unit. However, in the inkjet recording device disclosed in JP-A-2012-116093, the adhesion of the cleaning liquid onto the recording medium can be suppressed only when the recording medium is transported in the reverse direction by a short distance. On the other hand, there are many cases in which a user wants to transport the recording medium in the reverse direction by a longer distance, such as when the recording medium placed on the transporting belt is lifted, or when the user wants to check a recorded image. However, the inkjet recording device disclosed in JP-A-2012-116093 cannot handle such cases.

SUMMARY

A recording device according to the present disclosure for solving the above-described problems includes a plurality of rollers configured to rotate in a normal rotation direction and a reverse rotation direction opposite to the normal rotation direction, a transporting belt that is endless and stretched across the plurality of rollers, the transporting belt being configured to rotate in the normal rotation direction, by rotation of the plurality of rollers in the normal rotation direction, to transport a recording medium placed in a placement range of a front surface of the transporting belt in a normal transport direction, and to rotate in the reverse rotation direction, by rotation of the plurality of rollers in the reverse rotation direction, to transport the recording medium placed in the placement range in a reverse transport direction, a recording head configured to eject ink onto the recording medium placed on the transporting belt to perform recording, a cleaning liquid attaching unit configured to attach a cleaning liquid to the front surface at a position downstream in the normal transport direction of a position, outside the placement range, where the recording medium is peeled from the front surface, a first blade configured to come into contact with the front surface to remove the cleaning liquid attached to the front surface by the cleaning liquid attaching unit, and a blade moving unit configured to move the first blade in approaching and separating directions with respect to the front surface, which are directions approaching and moving away from the front surface. The recording head, the first blade, and the cleaning liquid attaching unit are arranged in this order from upstream in the normal transport direction of the transporting belt, and the blade moving unit causes the first blade to come into contact with the front surface when the transporting belt is rotating in the reverse rotation direction, and causes the first blade to be separated from the front surface when the transporting belt is rotating in the normal rotation direction.

Another recording device according to the present disclosure for solving the above-described problems includes a plurality of rollers configured to rotate in a normal rotation direction and a reverse rotation direction opposite to the normal rotation direction, a transporting belt that is endless and stretched across the plurality of rollers, the transporting belt being configured to rotate in the normal rotation direction, by rotation of the plurality of rollers in the normal rotation direction, to transport a recording medium placed in a placement range of a front surface of the transporting belt in a normal transport direction, and to rotate in the reverse rotation direction, by rotation of the plurality of rollers in the reverse rotation direction, to transport the recording medium placed in the placement range in a reverse transport direction, a recording head configured to eject ink onto the recording medium placed on the transporting belt to perform recording, a cleaning liquid attaching unit configured to attach a cleaning liquid to the front surface at a position downstream in the normal transport direction of a position, outside the placement range, where the recording medium is peeled from the front surface, a cleaning liquid attaching unit moving unit configured to move the cleaning liquid attaching unit between a contact position where the cleaning liquid is attached to the front surface and a non-contact position where the cleaning liquid is not attached to the front surface, a blade configured to come into contact with the front surface to remove the cleaning liquid attached to the front surface by the cleaning liquid attaching unit, a blade moving unit configured to move the blade in approaching and separating directions with respect to the front surface, the approaching and separating directions being directions corresponding to movement directions of the cleaning liquid attaching unit moving unit and being directions approaching and moving away from the front surface, and a control unit configured to control the rotation of the transporting belt in the normal rotation direction and the reverse rotation direction, and the movement of the cleaning liquid attaching unit and the blade in the approaching and separating directions. The recording head, the blade, and the cleaning liquid attaching unit are arranged in this order from upstream in the normal transport direction of the transporting belt, and when causing the transporting belt to rotate in the reverse rotation direction, the control unit positions the cleaning liquid attaching unit in the non-contact position, then, while the blade is in contact with the front surface, causes the transporting belt to rotate in the normal rotation direction until a region of the front surface previously in contact with the cleaning liquid attaching unit passes the blade, causes the blade to be separated from the front surface, and then, while the blade is separated from the front surface, causes the transporting belt to rotate in the reverse rotation direction.

Further, a method for reversely transporting a recording medium for solving the above-described problems is a method for reversely transporting the recording medium in a recording device that includes a plurality of rollers configured to rotate in a normal rotation direction and a reverse rotation direction opposite to the normal rotation direction, a transporting belt that is endless and stretched across the plurality of rollers, the transporting belt being configured to rotate in the normal rotation direction, by rotation of the plurality of rollers in the normal rotation direction, to transport a recording medium placed in a placement range of a front surface of the transporting belt in a normal transport direction, and to rotate in the reverse rotation direction, by rotation of the plurality of rollers in the reverse rotation direction, to transport the recording medium placed in the placement range in a reverse transport direction, a recording head configured to eject ink onto the recording medium placed on the transporting belt to perform recording, a cleaning liquid attaching unit configured to attach a cleaning liquid to the front surface at a position downstream in the normal transport direction of a position, outside the placement range, where the recording medium is peeled from the front surface, a cleaning liquid attaching unit moving unit configured to move the cleaning liquid attaching unit between a contact position where the cleaning liquid is attached to the front surface and a non-contact position where the cleaning liquid is not attached to the front surface, a blade configured to come into contact with the front surface to remove the cleaning liquid attached to the front surface by the cleaning liquid attaching unit, and a blade moving unit configured to move the blade in approaching and separating directions with respect to the front surface, the approaching and separating directions being directions corresponding to movement directions of the cleaning liquid attaching unit moving unit and being directions approaching and moving away from the front surface. The recording head, the cleaning liquid attaching unit, and the blade are arranged in this order from upstream in the normal transport direction of the transporting belt. The method for reversely transporting the recording medium includes positioning the cleaning liquid attaching unit at the non-contact position, rotating the transporting belt in the normal rotation direction, while the blade is in contact with the front surface, until a region of the front surface previously in contact with the cleaning liquid attaching unit passes the blade, causing the blade to be separated from the front surface, and causing the transporting belt to rotate in the reverse rotation direction while the blade is separated from the front surface.

DESCRIPTION OF EXEMPLARY EMBODIMENTS

Figure 1:
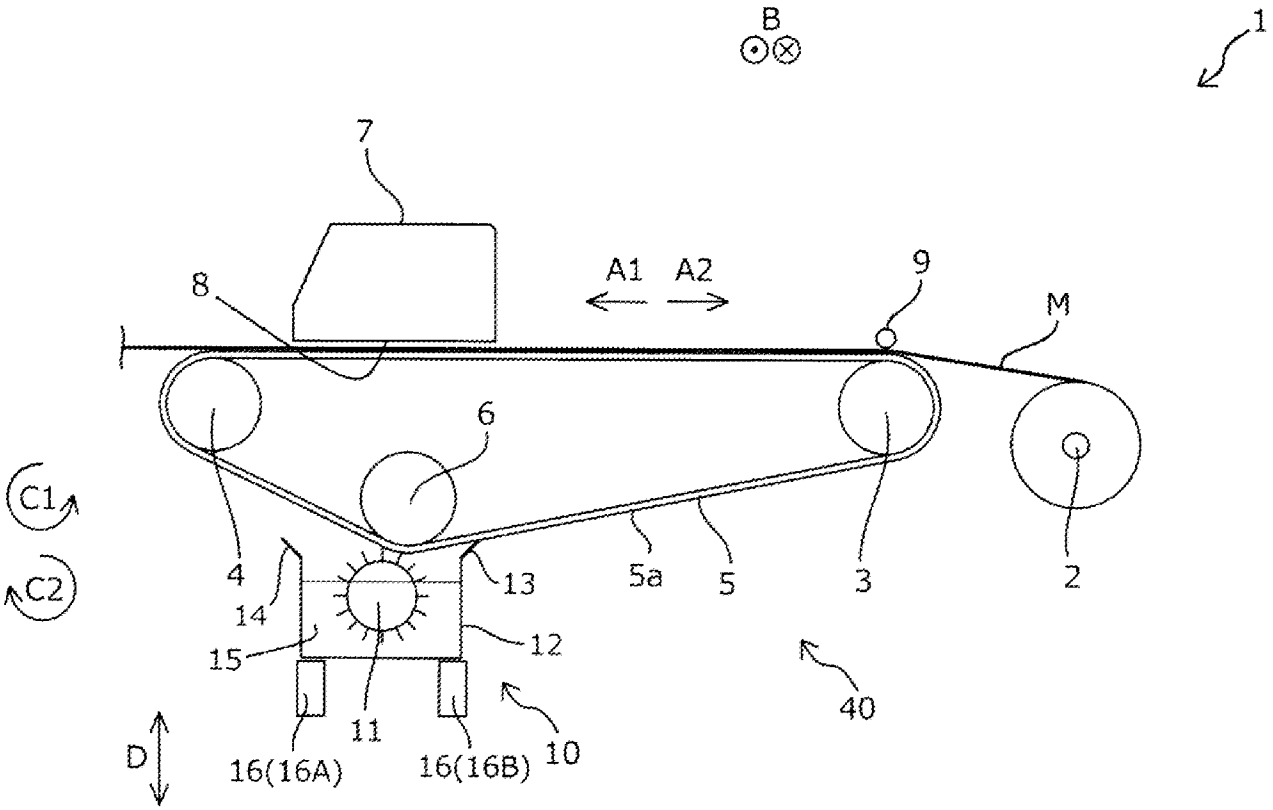
FIG. 1 is a schematic side view of a recording device according to Example 1 of the present disclosure, when transporting a recording medium in a normal transport direction.

First, the present disclosure will be schematically described.

A recording device according to a first aspect of the present disclosure for solving the above-described problems includes a plurality of rollers configured to rotate in a normal rotation direction and a reverse rotation direction opposite to the normal rotation direction, a transporting belt that is endless and stretched across the plurality of rollers, the transporting belt being configured to rotate in the normal rotation direction, by rotation of the plurality of rollers in the normal rotation direction, to transport a recording medium placed in a placement range of a front surface of the transporting belt in a normal transport direction, and to rotate in the reverse rotation direction, by rotation of the plurality of rollers, to transport the recording medium placed in the placement range in a reverse transport direction in the reverse rotation direction, a recording head configured to eject ink onto the recording medium placed on the transporting belt to perform recording, a cleaning liquid attaching unit configured to attach a cleaning liquid to the front surface at a position downstream in the normal transport direction of a position, outside the placement range, where the recording medium is peeled from the front surface, a first blade configured to come into contact with the front surface to remove the cleaning liquid attached to the front surface by the cleaning liquid attaching unit, and a blade moving unit configured to move the first blade in approaching and separating directions with respect to the front surface, which are directions approaching and moving away from the front surface. The recording head, the first blade, and the cleaning liquid attaching unit are arranged in this order from upstream in the normal transport direction of the transporting belt, and the blade moving unit causes the first blade to come into contact with the front surface when the transporting belt is rotating in the reverse rotation direction, and causes the first blade to be separated from the front surface when the transporting belt is rotating in the normal rotation direction.

According to this aspect, the first blade is provided between the recording head and the cleaning liquid attaching unit, and when the transporting belt is rotating in the reverse rotation direction to perform reverse transportation, by causing the first blade to come into contact with the front surface of the transporting belt, it is possible for the first blade to remove the cleaning liquid attached to the front surface of the transporting belt before the cleaning liquid reaches the recording medium. Thus, when the recording medium is reversely transported, adhesion of the cleaning liquid to the recording medium can be suppressed.

In the recording device according to a second aspect, with respect to the first aspect, the cleaning liquid attaching unit includes a cleaning liquid tank storing the cleaning liquid, and a rotary brush rotating in a state in which a portion thereof is immersed in the cleaning liquid while being in contact with the front surface, the first blade is fixed to the cleaning liquid tank, and the blade moving unit moves the first blade in the approaching and separating directions with respect to the front surface by moving the cleaning liquid tank.

According to this aspect, the transporting belt can be effectively cleaned using the rotary brush. Further, by adopting a configuration in which the first blade is moved in the approaching and separating directions with respect to the front surface of the transporting belt by moving the cleaning liquid tank, a movement mechanism of the cleaning liquid tank provided with the rotary brush and a movement mechanism of the first blade can be integrated as one mechanism, and thus the configuration of the device can be simplified.

With respect to the first aspect, the recording device according to a third aspect includes a second blade configured to come into contact with the front surface to remove the cleaning liquid attached to the front surface by the cleaning liquid attaching unit. The blade moving unit is configured to move the second blade in the approaching and separating directions with respect to the front surface, the recording head, the first blade, the cleaning liquid attaching unit, and the second blade are arranged in this order from upstream in the normal transport direction of the transporting belt, and the blade moving unit causes the second blade to be separated from the front surface when the transporting belt is rotating in the reverse rotation direction, and causes the second blade to come into contact with the front surface when the transporting belt is rotating in the normal rotation direction.

According to this aspect, the second blade is provided downstream of the cleaning liquid attaching unit in the normal transport direction of the transporting belt. Then, when the transporting belt is rotating in the normal rotation direction, the second blade is caused to come into contact with the front surface of the transporting belt. Thus, when transporting the recording medium in the normal transport direction, such as during a recording operation, before the cleaning liquid reaches the recording medium, the cleaning liquid attached to the front surface of the transporting belt by the cleaning liquid attaching unit can be removed using the second blade.

With respect to the second aspect, the recording device according to a fourth aspect includes a second blade configured to come into contact with the front surface to remove the cleaning liquid attached to the front surface by the cleaning liquid attaching unit. The second blade is fixed to the cleaning liquid tank, the blade moving unit is configured to move the second blade in the approaching and separating directions with respect to the front surface by moving the cleaning liquid tank, the recording head, the first blade, the cleaning liquid attaching unit, and the second blade are arranged in this order from upstream in the normal transport direction of the transporting belt, and the blade moving unit causes the second blade to be separated from the front surface when the transporting belt is rotating in the reverse rotation direction, and causes the second blade to come into contact with the front surface when the transporting belt is rotating in the normal rotation direction.

According to this aspect, the second blade is provided downstream of the cleaning liquid attaching unit in the normal transport direction of the transporting belt. Then, when the transporting belt is rotating in the normal rotation direction, the second blade is caused to come into contact with the front surface of the transporting belt. Thus, when transporting the recording medium in the normal transport direction, such as during the recording operation, before the cleaning liquid reaches the recording medium, the cleaning liquid attached to the front surface of the transporting belt by the cleaning liquid attaching unit can be removed using the second blade. Further, according to this aspect, by adopting a configuration in which the second blade, in addition to the first blade, is moved in the approaching and separating directions with respect to the front surface of the transporting belt by moving the cleaning liquid tank, the movement mechanism of the cleaning liquid tank provided with the rotary brush, the movement mechanism of the first blade, and a movement mechanism of the second blade can be integrated as one mechanism, and thus the configuration of the device can be simplified.

In the recording device according to a fifth aspect, with respect to the second or fourth aspect, the blade moving unit moves the first blade in the approaching and separating directions with respect to the front surface by inclining the cleaning liquid tank as viewed from a rotation axis direction of the plurality of rollers.

According to this aspect, the first blade can be moved in the approaching and separating directions with respect to the front surface by inclining the cleaning liquid tank.

With respect to the third aspect, the recording device according to a sixth aspect includes a storage unit to which the first blade is attached and configured to store the cleaning liquid removed from the front surface by the first blade. The blade moving unit moves the first blade in the approaching and separating directions with respect to the front surface by moving the storage unit.

According to this aspect, the storage unit is provided to which the first blade is attached and which stores the cleaning liquid removed from the front surface of the transporting belt by the first blade. Thus, it is possible to inhibit the cleaning liquid removed from the front surface of the transporting belt by the first blade from staining the device. Further, since the blade moving unit is configured such that the first blade is moved in the approaching and separating directions with respect to the front surface of the transporting belt by moving the storage unit, a movement mechanism of the storage unit and the movement mechanism of the first blade can be integrated as one mechanism, and thus the configuration of the device can be simplified.

In the recording device according to a seventh aspect, with respect to the sixth aspect, the cleaning liquid attaching unit includes a cleaning liquid tank storing the cleaning liquid, and a rotary brush rotating in a state in which a portion thereof is immersed in the cleaning liquid while being in contact with the front surface, the second blade is fixed to the cleaning liquid tank, and by moving the cleaning liquid tank, the blade moving unit causes the second blade to be separated from the front surface when the transporting belt is rotating in the reverse rotation direction, and causes the second blade to come into contact with the front surface when the transporting belt is rotating in the normal rotation direction.

According to this aspect, the transporting belt can be effectively cleaned using the rotary brush. Further, according to this aspect, when the transporting belt is rotating in the normal rotation direction, the second blade is caused to come into contact with the front surface of the transporting belt. Thus, when transporting the recording medium in the normal transport direction, such as during the recording operation, before the cleaning liquid reaches the recording medium, the cleaning liquid attached to the front surface of the transporting belt by the cleaning liquid attaching unit can be removed using the second blade.

In the recording device according to an eight aspect, with respect to the sixth aspect, the cleaning liquid attaching unit includes a cleaning liquid tank storing the cleaning liquid, and a rotary brush rotating in a state in which a portion thereof is immersed in the cleaning liquid while being in contact with the front surface, and a flow path, of the cleaning liquid, that connects the storage unit to the cleaning liquid tank is provided.

According to this aspect, the transporting belt can be effectively cleaned using the rotary brush. Further, according to this aspect, since the flow path, of the cleaning liquid, that connects the storage unit to the cleaning liquid tank is provided, the cleaning liquid can be repeatedly used, and wasteful use of the cleaning liquid can be suppressed.

A recording device according to a ninth aspect of the present disclosure includes a plurality of rollers configured to rotate in a normal rotation direction and a reverse rotation direction opposite to the normal rotation direction, a transporting belt that is endless and stretched across the plurality of rollers, the transporting belt being configured to rotate in the normal rotation direction, by rotation of the plurality of rollers, to transport a recording medium placed in a placement range of a front surface of the transporting belt in a normal transport direction in the normal rotation direction, and to rotate in the reverse rotation direction, by rotation of the plurality of rollers, to transport the recording medium placed in the placement range in a reverse transport direction in the reverse rotation direction, a recording head configured to eject ink onto the recording medium placed on the transporting belt to perform recording, a cleaning liquid attaching unit configured to attach a cleaning liquid to the front surface at a position downstream in the normal transport direction of a position, outside the placement range, where the recording medium is peeled from the front surface, a cleaning liquid attaching unit moving unit configured to move the cleaning liquid attaching unit between a contact position where the cleaning liquid is attached to the front surface and a non-contact position where the cleaning liquid is not attached to the front surface, a blade configured to come into contact with the front surface to remove the cleaning liquid attached to the front surface by the cleaning liquid attaching unit, a blade moving unit configured to move the blade in approaching and separating directions with respect to the front surface, the approaching and separating directions being directions corresponding to movement directions of the cleaning liquid attaching unit moving unit and being directions approaching and moving away from the front surface, and a control unit configured to control the rotation of the transporting belt in the normal rotation direction and the reverse rotation direction, and the movement of the cleaning liquid attaching unit and the blade in the approaching and separating directions. The recording head, the blade, and the cleaning liquid attaching unit are arranged in this order from upstream in the normal transport direction of the transporting belt, and when causing the transporting belt to rotate in the reverse rotation direction, the control unit positions the cleaning liquid attaching unit in the non-contact position, then, while the blade is in contact with the front surface, causes the transporting belt to rotate in the normal rotation direction until a region of the front surface previously in contact with the cleaning liquid attaching unit passes the blade, causing the blade to be separated from the front surface, and then, while the blade is separated from the front surface, causes the transporting belt to rotate in the reverse rotation direction.

According to this aspect, the blade is provided downstream of the cleaning liquid attaching unit in the normal transport direction, and when the transporting belt is rotated in the reverse rotation direction, the cleaning liquid attaching unit is positioned at the non-contact position, the transporting belt is rotated in the normal rotation direction until the region of the front surface previously in contact with the cleaning liquid attaching unit passes the blade while the blade is in contact with the front surface of the transporting belt, the blade is separated from the front surface, and while the blade is separated from the front surface, the transporting belt is rotated in the reverse rotation direction. Thus, when the recording medium is reversely transported, the adhesion of the cleaning liquid to the recording medium can be suppressed.

A method for reversely transporting a recording medium according to a tenth aspect of the present disclosure is a method for reversely transporting the recording medium in a recording device that includes a plurality of rollers configured to rotate in a normal rotation direction and a reverse rotation direction opposite to the normal rotation direction, a transporting belt that is endless and stretched across the plurality of rollers, the transporting belt being configured to rotate in the normal rotation direction, by rotation of the plurality of rollers in the normal rotation direction, to transport a recording medium placed in a placement range of a front surface of the transporting belt in a normal transport direction, and to rotate in the reverse rotation direction, by rotation of the plurality of rollers, to transport the recording medium placed in the placement range in a reverse transport direction in the reverse rotation direction, a recording head configured to eject ink onto the recording medium placed on the transporting belt to perform recording, a cleaning liquid attaching unit configured to attach a cleaning liquid to the front surface at a position downstream in the normal transport direction of a position, outside the placement range, where the recording medium is peeled from the front surface, a cleaning liquid attaching unit moving unit configured to move the cleaning liquid attaching unit between a contact position where the cleaning liquid is attached to the front surface and a non-contact position where the cleaning liquid is not attached to the front surface, a blade configured to come into contact with the front surface to remove the cleaning liquid attached to the front surface by the cleaning liquid attaching unit, and a blade moving unit configured to move the blade in approaching and separating directions with respect to the front surface, the approaching and separating directions being directions corresponding to movement directions of the cleaning liquid attaching unit moving unit and being directions approaching and moving away from the front surface. The recording head, the cleaning liquid attaching unit, and the blade are arranged in this order from upstream in the normal transport direction of the transporting belt. The method for reversely transporting the recording medium includes positioning the cleaning liquid attaching unit at the non-contact position, rotating the transporting belt in the normal rotation direction, while the blade is in contact with the front surface, until a region of the front surface previously in contact with the cleaning liquid attaching unit passes the blade, causing the blade to be separated from the front surface, and causing the transporting belt to rotate in the reverse rotation direction while the blade is separated from the front surface.

According to this aspect, in the recording device provided with the blade downstream of the cleaning liquid attaching unit in the normal transport direction, when the transporting belt is rotated in the reverse rotation direction, the cleaning liquid attaching unit is positioned at the non-contact position, the transporting belt is rotated in the normal rotation direction until the region of the front surface previously in contact with the cleaning liquid attaching unit passes the blade while the blade is in contact with the front surface of the transporting belt, the blade is separated from the front surface, and while the blade is separated from the front surface, the transporting belt is rotated in the reverse rotation direction. Thus, when the recording medium is reversely transported, the adhesion of the cleaning liquid to the recording medium can be suppressed.

Embodiments according to the present disclosure will be described below with reference to the accompanying drawings.

EXAMPLE 1

First, an overview of a recording device 1 according to Example 1 of the present disclosure will be described with reference to FIG. 1 and FIG. 2.

As illustrated in FIG. 1, the recording device 1 according to this example includes a setting unit 2 on which a roll-shaped recording medium M is set. Further, the recording device 1 includes a transport device 40 that can transport the recording medium M fed from the setting unit 2 in a normal transport direction A1 and a reverse transport direction A2, which is the opposite direction to the normal transport direction A1. Here, the normal transport direction A1 is a transport direction of the recording medium M when recording is performed on the recording medium M. The transport device 40 includes a driven roller 3 located upstream in the normal transport direction A1, a driving roller 4 located downstream in the normal transport direction A1, a transporting belt 5 that is an endless belt stretched across the driven roller 3 and the driving roller 4, and an adjustment roller 6 that adjusts various parameters of the transporting belt 5. Specifically, the parameters that can be adjusted by the adjustment roller 6 are the circumferential length of the transporting belt 5 and the tension of the transporting belt 5. Further, the recording device 1 includes a cleaning unit 10 that cleans the transporting belt 5. Here, when transporting the recording medium M in the normal transport direction A1, by rotating the driving roller 4 in a normal rotation direction C1, the transporting belt 5 is rotated in the normal rotation direction C1. Conversely, when transporting the recording medium M in the reverse transport direction A2, by rotating the driving roller 4 in a reverse rotation direction C2, the transporting belt 5 is rotated in the reverse rotation direction C2. Note that, in the following description, the rotation in the normal rotation direction C1 will be referred to as a normal rotation, and the rotation in the reverse rotation direction C2 will be referred to as a reverse rotation.

Here, the transporting belt 5 is an adhesive belt with an adhesive coated on a support face 5*a*, which is an outer surface of the transporting belt 5. As illustrated in FIG. 1 and FIG. 2, the recording medium M is transported while being supported by the transporting belt 5, in a state in which the recording medium M is affixed to the support face 5*a* coated with the adhesive. A region, of the transporting belt 5, that supports the recording medium M is an upper region of the transporting belt 5 stretched across the driven roller 3 and the driving roller 4. In other words, the recording medium M is affixed to the support face 5*a* at a position facing the driven roller 3, and peeled from the support face 5*a* at a position facing the driving roller 4. Further, the driving roller 4 is a roller that is rotated by a driving force from a transport motor 28 illustrated in FIG. 3, and the driven roller 3 is a roller that rotates in response to the rotation of the transporting belt 5, which is caused by the rotation of the driving roller 4.

Note that, similarly to the driven roller 3, the adjustment roller 6 is also a roller that rotates in response to the rotation of the transporting belt 5, which is caused by the rotation of the driving roller 4. The adjustment roller 6 is configured such that an end portion thereof on a first side and an end portion thereof on a second side in a width direction B can independently move in a vertical direction D. As a result, the circumferential length of the transporting belt 5 on the first side in the width direction B and the circumferential length of the transporting belt 5 on the second side in the width direction B can be independently changed. When the circumferential lengths of the transporting belt 5 on the first side and on the second side in the width direction B are different from each other, there is a risk that the recording medium M may meander when the recording medium M is transported. Thus, it is preferable that a difference in the circumferential lengths of the transporting belt 5 on the first side and the second side in the width direction B be as small as possible. For example, when the circumferential length of the transporting belt 5 on the first side in the width direction B is longer than the circumferential length of the transporting belt 5 on the second side in the width direction B, by moving the end portion, of the adjustment roller 6, on the first side in the width direction B upward in the vertical direction D, the circumferential length of the transporting belt 5 on the first side in the width direction B is shortened, and the difference in the circumferential lengths of the transporting belt 5 on the first side and the second side in the width direction B can be reduced. Alternatively, in a similar situation, by moving the end portion, of the adjustment roller 6, on the second side in the width direction B downward in the vertical direction D, the circumferential length of the transporting belt 5 on the second side in the width direction B is increased, and the difference in the circumferential lengths of the transporting belt 5 on the first side and the second side in the width direction B can be reduced. Note that although it is ideal that the difference in the circumferential lengths is zero, there may be a slight difference in the circumferential lengths as long as the recording medium M does not meander.

Further, the adjustment roller 6 can also be used to adjust the tension of the transporting belt 5. For example, by moving the end portion of the adjustment roller 6 on the first side and the end portion thereof on the second side in the width direction B in the vertical direction D by the same amount, the tension of the transporting belt 5 can be adjusted without changing the difference in the circumferential lengths of the transporting belt 5 on the first side and the second side in the width direction B. Specifically, by moving the end portion of the adjustment roller 6 on the first side and the end portion thereof on the second side in the width direction B upward in the vertical direction D, the tension of the transporting belt 5 is reduced. Further, by moving the end portion of the adjustment roller 6 on the first side and the end portion thereof on the second side in the width direction B downward in the vertical direction D, the tension of the transporting belt 5 is increased.

Further, the recording device 1 includes a carriage 7 that can reciprocate in the width direction B intersecting the transport direction A, and a recording head 8 attached to the carriage 7. The recording head 8 functions as an ejection unit that can eject ink onto the recording medium M transported in the transport direction A to form an image. The recording head 8 is provided at a position facing the region, of the transporting belt 5, that supports the recording medium M, and is able to eject the ink. The recording device 1 according to this example can eject the ink onto the transported recording medium M from the recording head 8 to form the image, while causing the carriage 7 to reciprocate in the width direction B intersecting the normal transport direction A1 and the reverse transport direction A2. By including the carriage 7 having such a configuration, the recording device 1 according to this example can form a desired image on the recording medium M by repeating the transport of the recording medium M in the normal transport direction A1 by a predetermined transport amount, and the ejection of the ink while moving the carriage 7 in the width direction B in a state in which the recording medium M is stopped.

Note that the recording device 1 according to this example is what is known as a serial printer, which alternately repeats the transport of the recording medium M by the predetermined amount and the reciprocating movement of the carriage 7 to perform the recording. However, the recording device 1 may also be what is known as a line printer, which continuously transports the recording medium M to continuously perform the recording using a line head in which nozzles are arranged in a straight line along the width direction B of the recording medium M.

Further, a medium affixing unit 9 is formed at a position, facing the transporting belt 5, upstream of the carriage 7 in the normal transport direction A. The medium affixing unit 9 affixes the recording medium M to the transporting belt 5 while suppressing the generation of wrinkles and the like, by pressing the recording medium M against the transporting belt 5 across the width direction B.

Upon being discharged from the recording device 1 according to this example, the recording medium M on which the image has been formed is transported to a drying device that volatilizes components of the ink ejected onto the recording medium M, a winding device that takes up the recording medium M on which the image has been formed, and the like, which are provided in stages subsequent to the recording device 1 according to this example.

Here, as the recording medium M, a printable material can be preferably used. The term "printable material" refers to a fabric, a garment, and other clothing products on which printing can be performed. Fabrics include natural fibers such as cotton, silk and wool, chemical fibers such as nylon, or composite fibers of natural fibers and chemical fibers such as woven cloths, knit fabrics, and non-woven cloths. Further, garments and other clothing products include sewn products such as a T-shirt, handkerchief, scarf, towel, handbag, and fabric bag, and furniture-related products such as a curtain, sheet, and bed cover, as well as fabrics before and after cutting that serve as pieces of cloth before sewing.

Furthermore, in addition to the printable material described above, the recording medium M may be special paper for inkjet recording, such as plain paper, pure paper, or glossy paper. Further, other materials that can be used as the recording medium M include, for example, plastic films on which a surface treatment for inkjet recording is not performed, in other words, on which an ink absorption layer is not formed, as well as substrates such as paper substrates to which a plastic coating is applied, or to which a plastic film is attached. Such plastic materials include, but are not limited to, for example, polyvinyl chloride, polyethylene terephthalate, polycarbonate, polystyrene, polyurethane, polyethylene, and polypropylene.

When the printable material is used as the recording medium M, since bleed-through of the ink easily occurs, which is a phenomenon in which the ink ejected onto the recording medium M seeps through to a back surface of the recording medium M, the transporting belt 5 may be stained by the ink. Thus, the recording device 1 according to this example is provided with the cleaning unit 10 for cleaning the ink that has bled through and attached to the transporting belt 5. The cleaning unit 10 according to this example is provided with a cleaning liquid tank 12 that stores a cleaning liquid 15, and a rotary brush 11 that is immersed in the cleaning liquid 15 stored in the cleaning liquid tank 12 and comes into contact with the transporting belt 5. In this example, water is used as the cleaning liquid 15. However, another liquid may be used as the cleaning liquid 15. For example, a liquid containing a predetermined cleaning component may be used as the cleaning liquid 15.

The cleaning unit 10 includes a downstream blade 13 that can remove the cleaning liquid 15 attached to the support face 5*a*, at a position downstream of the rotary brush 11 in the normal transport direction A1. Further, the cleaning unit 10 includes an upstream blade 14 that can remove the cleaning liquid 15 attached to the support face 5*a*, at a position downstream of the rotary brush 11 in the reverse transport direction A2, in other words, at a position upstream of the rotary brush 11 in the normal transport direction A1. Both the downstream blade 13 and the upstream blade 14 extend along the width direction B. The downstream blade 13 is provided at the tip of a side surface portion, of the cleaning liquid tank 12, on the driven roller 3 side when viewed from the direction along the width direction B, and the upstream blade 14 is provided at the tip of a side surface portion, of the cleaning liquid tank 12, on the driving roller 4 side when viewed from the direction along the width direction B.

Here, the recording device 1 according to this example transports the recording medium M placed in a placement range of the support face 5*a*, which is the front surface of the transporting belt 5, in the normal transport direction A1 by normally rotating the endless transporting belt 5 stretched across the driven roller 3, the driving roller 4, and the adjustment roller 6, which are a plurality of rollers, as a result of rotating the plurality of rollers in the normal rotation direction C1. Further, by reversely rotating the plurality of rollers in the reverse rotation direction C2 so as to reversely rotate the transporting belt 5, the recording medium M placed in the placement range is transported in the reverse transport direction A2. The cleaning unit 10 is configured to be movable, and as illustrated in FIG. 1, when the recording medium M is transported in the normal transport direction A1, the downstream blade 13 is brought into contact with the support face 5*a*, and the upstream blade 14 is separated from the support face 5*a*. On the other hand, as illustrated in FIG. 2, when the recording medium M is transported in the reverse transport direction A2, the downstream blade 13 is separated from the support face 5*a*, and the upstream blade 14 is brought into contact with the support face 5*a*.

Here, a movement mechanism of the cleaning unit 10 will be described. As illustrated in FIG. 1 and FIG. 2, the cleaning unit 10 includes two air cylinders 16. Of the air cylinders 16, an air cylinder 16A is disposed at a bottom surface portion, of the cleaning liquid tank 12, on the side on which the upstream blade 14 is provided when viewed from the direction along the width direction B, and an air cylinder 16B is disposed at the bottom surface portion, of the cleaning liquid tank 12, on the side on which the downstream blade 13 is provided when viewed from the direction along the width direction B. Both the air cylinder 16A and the air cylinder 16B can be displaced along the vertical direction D. Thus, by separately displacing the air cylinders 16A and 16B, as illustrated in FIG. 1, the upstream blade 14 can be separated from the support face 5*a* while bringing the downstream blade 13 into contact with the support face 5*a*, and as illustrated in FIG. 2, the upstream blade 14 can be brought into contact with the support face 5*a* while separating the downstream blade 13 from the support face 5*a*.

Note that, as described above, in the recording device 1 according to this example, the two air cylinders 16 are provided as the movement mechanism of the cleaning unit 10. However, the recording device 1 is not limited to such a configuration. As the movement mechanism of the cleaning unit 10, the recording device 1 may include one, or three or more of the air cylinders 16, or may include a movement mechanism other than the air cylinder 16 for the cleaning unit 10.

Figure 3:
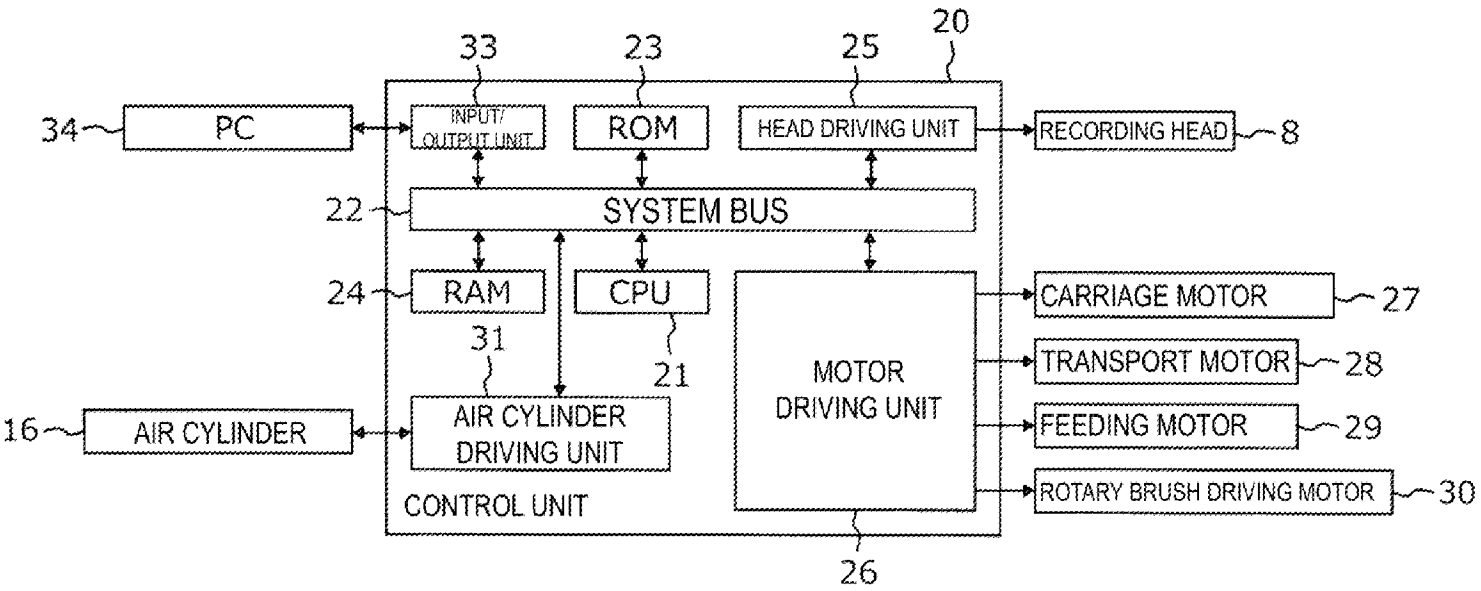
FIG. 3 is a block diagram illustrating an electrical configuration of the recording device according to Example 1 of the present disclosure.

Next, an electrical configuration of the recording device 1 according to this example will be described with reference to FIG. 3. As illustrated in FIG. 3, the recording device 1 according to this example includes a control unit 20. The control unit 20 includes a CPU 21 that performs control of the entire recording device 1. The CPU 21 is coupled, via a system bus 22, to a ROM 23 that stores various control programs to be executed by the CPU 21, and a RAM 24 that can temporarily store data.

Further, the CPU 21 is coupled, via the system bus 22, to a head driving unit 25 for driving the recording head 8, in other words, for ejecting the ink.

Further, the CPU 21 is coupled, via the system bus 22, to a motor driving unit 26 that is coupled to a carriage motor 27, a transport motor 28, a feeding motor 29, and a rotary brush driving motor 30. Here, the carriage motor 27 is a motor for causing the carriage 7, on which the recording head 8 is mounted, to reciprocate in the width direction B. Further, the transport motor 28 is a motor for driving the driving roller 4. Further, the feeding motor 29 is a rotation mechanism for the setting unit 2, and is a motor for driving the setting unit 2 to feed the recording medium M to the transporting belt 5. Then, the rotary brush driving motor 30 is a driving motor for the rotary brush 11.

Further, the CPU 21 is coupled, via the system bus 22, to an air cylinder driving unit 31 that drives the air cylinders 16.

Furthermore, the CPU 21 is coupled, via the system bus 22, to an input/output unit 33 that is coupled to a PC 34 for receiving and transmitting data such as image data, and signals.

Here, in summary of the description above, the recording device 1 according to this example includes the driven roller 3, the driving roller 4, and the adjustment roller 6, which are the plurality of rollers that can rotate in the normal rotation direction C1 and the reverse rotation direction C2. Further, the recording device 1 according to this example includes the endless transporting belt 5 that is stretched across the plurality of rollers, transports the recording medium M placed in the placement range of the support face 5*a* in the normal transport direction A1 by normally rotating as a result of the plurality of rollers being normally rotated, and transports the recording medium M placed in the placement range of the support face 5*a* in the reverse transport direction A2 by reversely rotating as a result of the plurality of rollers being reversely rotated. Further, the recording device 1 according to this example includes the recording head 8 that ejects the ink onto the recording medium M placed on the transporting belt 5 to perform the recording. Then, the recording device 1 according to this example includes the cleaning unit 10 that is provided with the rotary brush 11 that configures a cleaning liquid attaching unit that causes the cleaning liquid 15 to be attached to the support face 5*a* at a position downstream in the normal transport direction of a position, outside the placement range of the support face 5*a*, at which the recording medium M is peeled from the support face 5*a*, the upstream blade 14 that serves as a first blade that comes into contact with the support face 5*a* to remove the cleaning liquid 15 attached to the support face 5*a* by the rotary brush 11, and the air cylinders 16 that serve as a blade moving unit that causes the upstream blade 14 to move in approaching and separating directions with respect to the support face 5*a*, namely, in a direction in which the upstream blade 14 approaches and comes into contact with the support face 5*a* and in a direction in which the upstream blade 14 moves away from the support face 5*a*. Note that, as can be understood by comparing FIG. 1 and FIG. 2, in this example, the "approaching and separating directions" are diagonal directions inclined with respect to the vertical direction D when viewed from the width direction B, but may be the vertical direction D, the horizontal direction, or the like. Here, as illustrated in FIG. 1 and FIG. 2, in the recording device 1 according to this example, the recording head 8, the upstream blade 14, and the rotary brush 11 are arranged in this order from upstream in the normal transport direction A1 with respect to the transporting belt 5. Then, by the control unit 20 controlling the air cylinder driving unit 31, when the transporting belt 5 is reversely rotating as illustrated in FIG. 2, the air cylinders 16 cause the upstream blade 14 to come into contact with the support face 5*a*, and when the transporting belt 5 is normally rotating as illustrated in FIG. 1, the air cylinders 16 cause the upstream blade 14 to be separated from the support face 5*a*.

In this way, the recording device 1 according to this example includes the upstream blade 14 between the recording head 8 and the rotary brush 11, and when the transporting belt 5 is reversely rotating to reversely transport the recording medium M, the recording device 1 causes the upstream blade 14 to come into contact with the support face 5*a* of the transporting belt 5. As a result, before the cleaning liquid 15 attached to the support face 5*a* of the transporting belt 5 reaches the recording medium M, the cleaning liquid 15 can be removed using the upstream blade 14. Thus, in the recording device 1 according to this example, when the recording medium M is reversely transported, adhesion of the cleaning liquid 15 to the recording medium M can be suppressed.

Further, the recording device 1 according to this example includes, as the cleaning liquid attaching unit, the cleaning liquid tank 12 that stores the cleaning liquid 15, and the rotary brush 11 that rotates with a portion thereof immersed in the cleaning liquid 15 while being in contact with the support face 5*a*. Then, the upstream blade 14 is fixed to the cleaning liquid tank 12, and the air cylinders 16 cause the upstream blade 14 to move in the approaching and separating directions by moving the cleaning liquid tank 12. The recording device 1 according to this example can effectively clean the transporting belt 5 using the rotary brush 11. Further, the recording device 1 according to this example is configured such that the upstream blade 14 is moved in the approaching and separating directions with respect to the support face 5*a* of the recording medium M by moving the cleaning liquid tank 12. As a result, a movement mechanism of the cleaning liquid tank 12 provided with the rotary brush 11 and a movement mechanism of the upstream blade 14 are integrated as one mechanism, and thus the configuration of the device is simplified.

Further, as described above, the recording device 1 according to this example includes the downstream blade 13 that serves as a second blade that comes into contact with the support face 5*a* to remove the cleaning liquid 15 attached to the support face 5*a* by the rotary brush 11. Further, the air cylinders 16 can move the downstream blade 13 in the approaching and separating directions with respect to the support face 5*a*. Here, as illustrated in FIG. 1 and FIG. 2, in the recording device 1 according to this example, the recording head 8, the upstream blade 14, the rotary brush 11, and the downstream blade 13 are arranged in this order from upstream in the normal transport direction A1 with respect to the transporting belt 5. Then, when the transporting belt 5 is reversely rotating as illustrated in FIG. 2, the air cylinders 16 cause the downstream blade 13 to be separated from the support face 5*a*, and when the transporting belt 5 is normally rotating as illustrated in FIG. 1, the air cylinders 16 cause the downstream blade 13 to come into contact with the support face 5*a*.

In this way, the recording device 1 according to this example includes the downstream blade 13 provided downstream of the rotary brush 11 in the normal transport direction A1 with respect to the transporting belt 5. Then, when the transporting belt 5 is normally rotating, the downstream blade 13 is brought into contact with the support face 5*a* of the recording medium M. Thus, in the recording device 1 according to this example, when the recording medium M is transported in the normal transport direction A1, such as during a recording operation, before the cleaning liquid 15 reaches the recording medium M, the cleaning liquid 15 attached to the support face 5*a* of the transporting belt 5 by the rotary brush 11 can be removed by the downstream blade 13.

Further, when describing the downstream blade 13 from another perspective, in the recording device 1 according to this example, the downstream blade 13 is fixed to the cleaning liquid tank 12. Then, the air cylinders 16 can move the downstream blade 13 in the approaching and separating directions with respect to the support face 5*a* by moving the cleaning liquid tank 12. In this way, the recording device 1 according to this example is configured such that the downstream blade 13, in addition to the upstream blade 14, is moved in the approaching and separating directions with respect to the support face 5*a* of the transporting belt 5 by moving the cleaning liquid tank 12. As a result, the movement mechanism of the cleaning liquid tank 12 provided with the rotary brush 11, the movement mechanism of the upstream blade 14, and a movement mechanism of the downstream blade 13 are integrated as one mechanism, and thus the configuration of the device is simplified.

Figure 2:
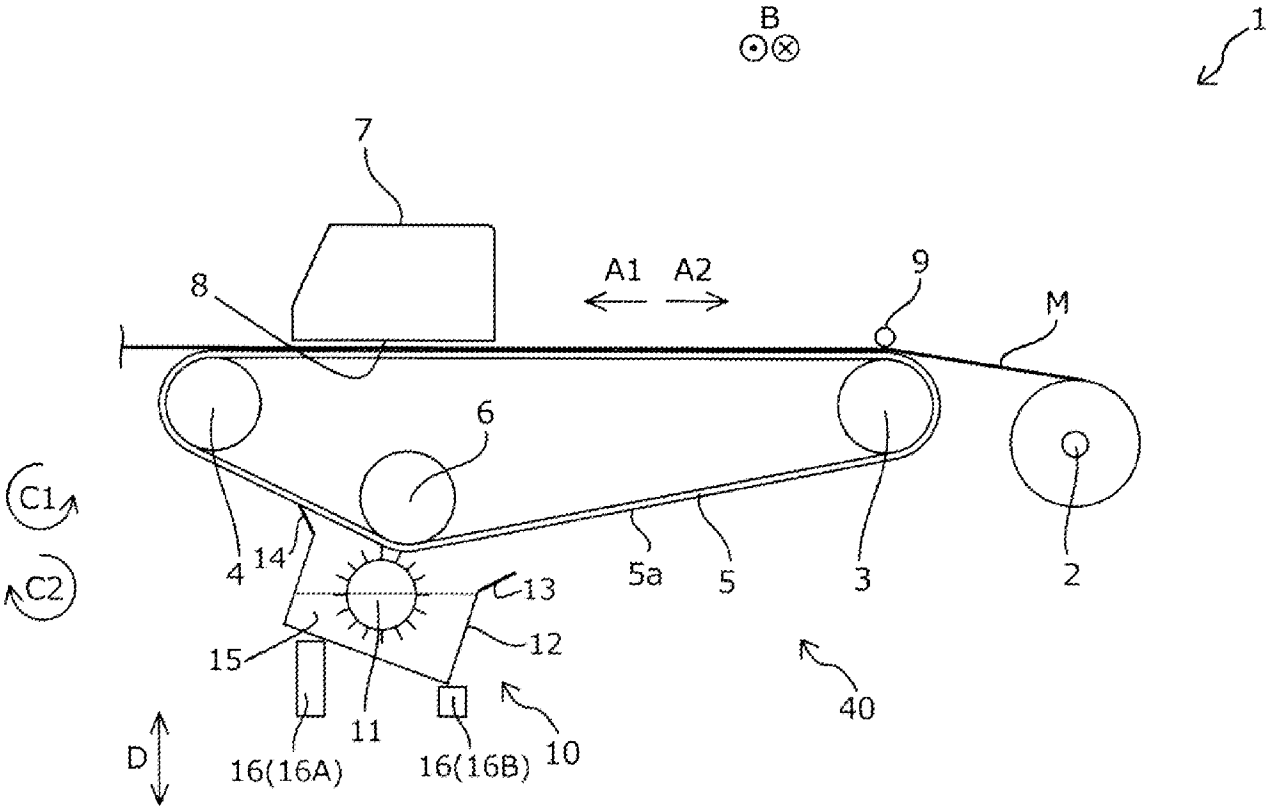
FIG. 2 is a schematic side view of the recording device according to Example 1 of the present disclosure, when transporting the recording medium in a reverse transport direction.

Further, in the recording device 1 according to this example, as illustrated in FIG. 2, when viewed from the width direction B, in other words, when viewed from a rotation axis direction of the plurality of rollers, the air cylinders 16 move the upstream blade 14 and the downstream blade 13 in the approaching and separating directions with respect to the support face 5*a* by inclining the cleaning liquid tank 12. In this way, the recording device 1 according to this example is configured so as to move the upstream blade 14 and the downstream blade 13 in the approaching and separating directions with respect to the support face 5*a* by inclining the cleaning liquid tank 12, but the recording device 1 is not limited to such a configuration.

EXAMPLE 2

Figure 4:
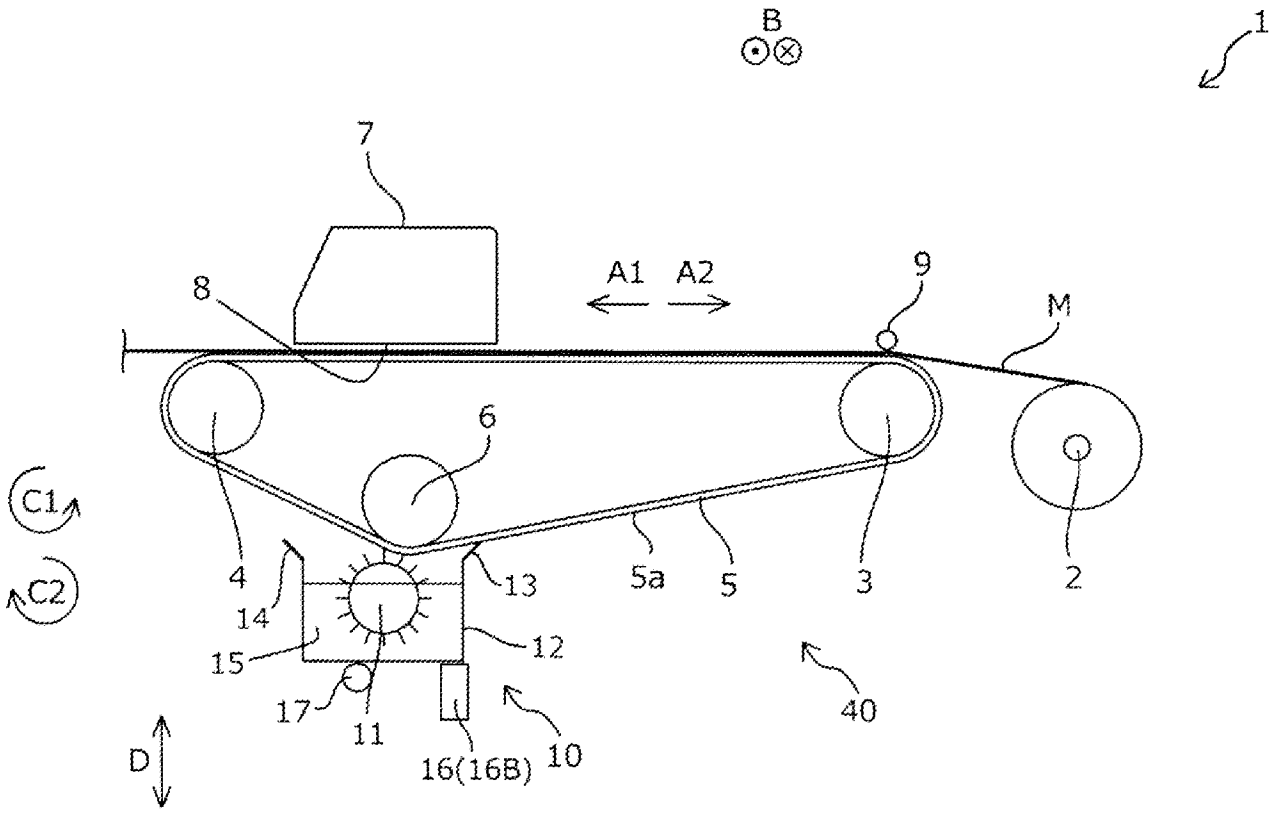
FIG. 4 is a schematic side view of the recording device according to Example 2 of the present disclosure, when transporting the recording medium in the normal transport direction.
Figure 5:
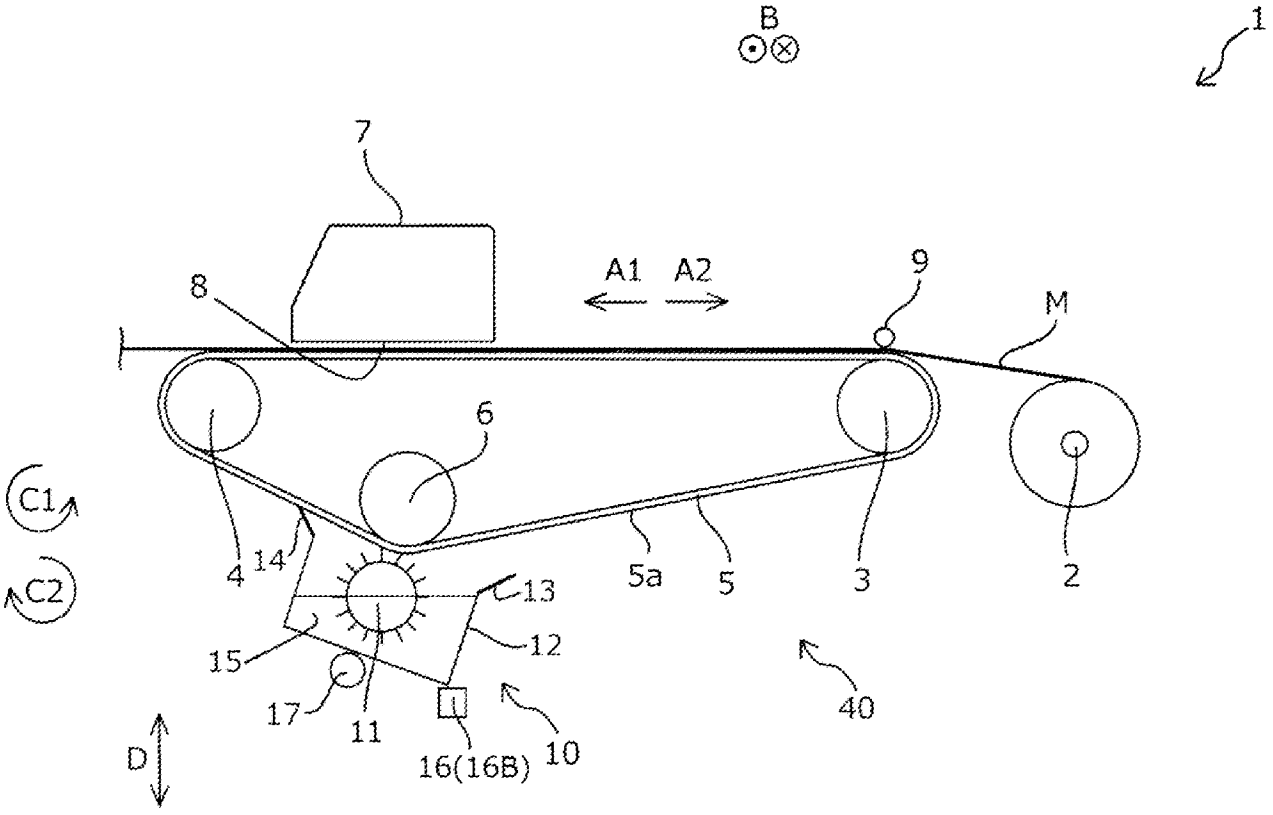
FIG. 5 is a schematic side view of the recording device according to Example 2 of the present disclosure, when transporting the recording medium in the reverse transport direction.

Next, the recording device 1 according to Example 2 will be described with reference to FIG. 4 and FIG. 5. FIG. 4 is a schematic side view illustrating the recording device 1 according to this example, and is a diagram corresponding to FIG. 1 relating to the recording device 1 according to Example 1. Further, FIG. 5 is a schematic side view illustrating the recording device 1 according to this example, and is a diagram corresponding to FIG. 2 relating to the recording device 1 according to Example 1. Here, the recording device 1 according to this example has the same configuration as that of the recording device 1 according to Example 1 except for the configuration of the blade moving unit in the cleaning unit 10. Thus, the recording device 1 according to this example has the same characteristics as those of the recording device 1 according to Example 1 except for characteristics to be described below, and a description of the common configurations will be omitted. Note that the constituent members common to those in Example 1 described above will be denoted by the same reference numerals, and a detailed description thereof will be omitted.

As described above, the recording device 1 according to Example 1 includes the two air cylinders 16, namely, the air cylinder 16A and the air cylinder 16B, as the blade moving unit. On the other hand, as illustrated in FIG. 4 and FIG. 5, in the recording device 1 according to this example, the blade moving unit includes the air cylinder 16B similar to the air cylinder 16B of the recording device 1 according to Example 1, and a support unit 17 that rotatably supports the cleaning liquid tank 12.

Then, in the recording device 1 according to this example, by extending and contracting the air cylinder 16B in the vertical direction D, the upstream blade 14 can be separated from the support face 5*a* while causing the downstream blade 13 to come into contact with the support face 5*a*, as illustrated in FIG. 4, and the upstream blade 14 can be brought into contact with the support face 5*a* while causing the downstream blade 13 to be separated from the support face 5*a*, as illustrated in FIG. 5. Note that, as in the recording device 1 according to Example 1, when the recording medium M is transported in the normal transport direction A1, the downstream blade 13 is brought into contact with the support face 5*a* and the upstream blade 14 is separated from the support face 5*a*, as illustrated in FIG. 4. On the other hand, when the recording medium M is transported in the reverse transport direction A2, the downstream blade 13 is separated from the support face 5*a* and the upstream blade 14 is brought into contact with the support face 5*a*, as illustrated in FIG. 5.

EXAMPLE 3

Figure 6:
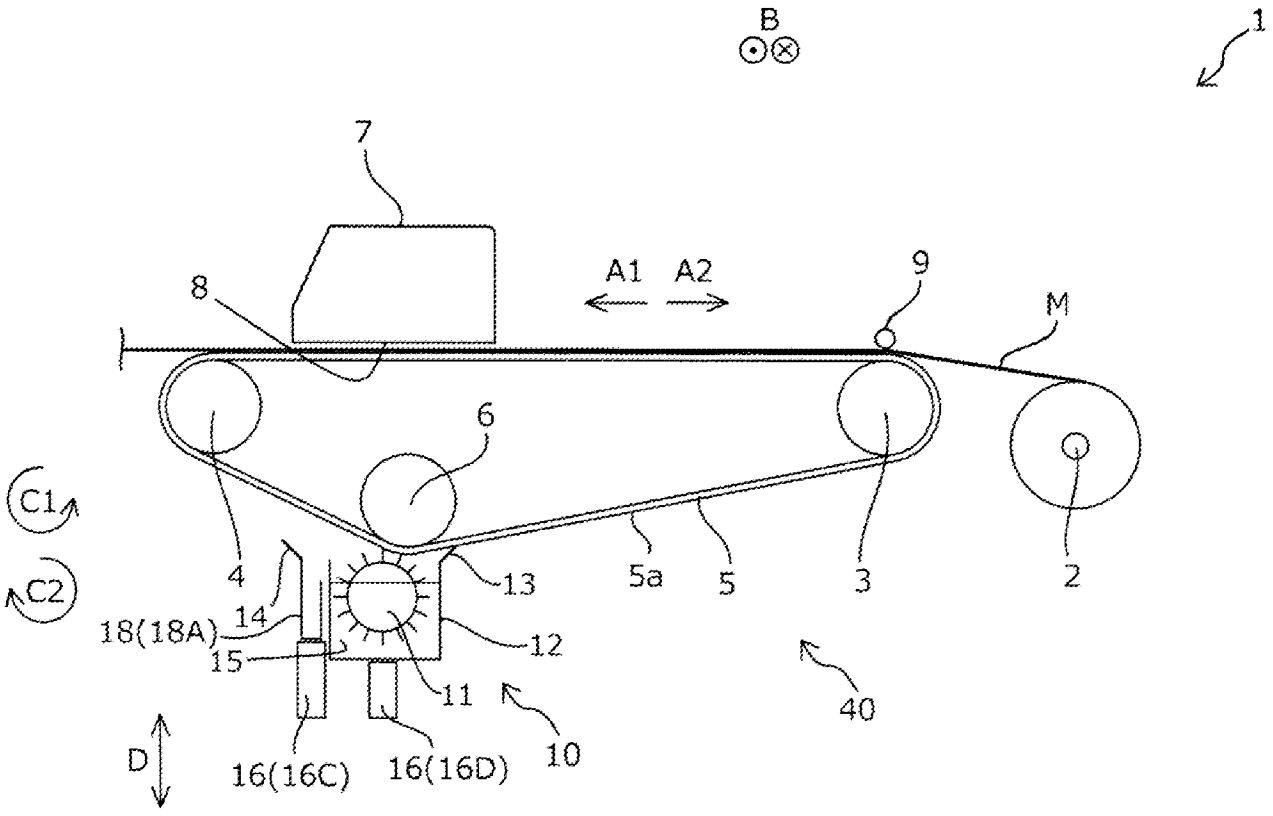
FIG. 6 is a schematic side view of the recording device according to Example 3 of the present disclosure, when transporting the recording medium in the normal transport direction.
Figure 7:
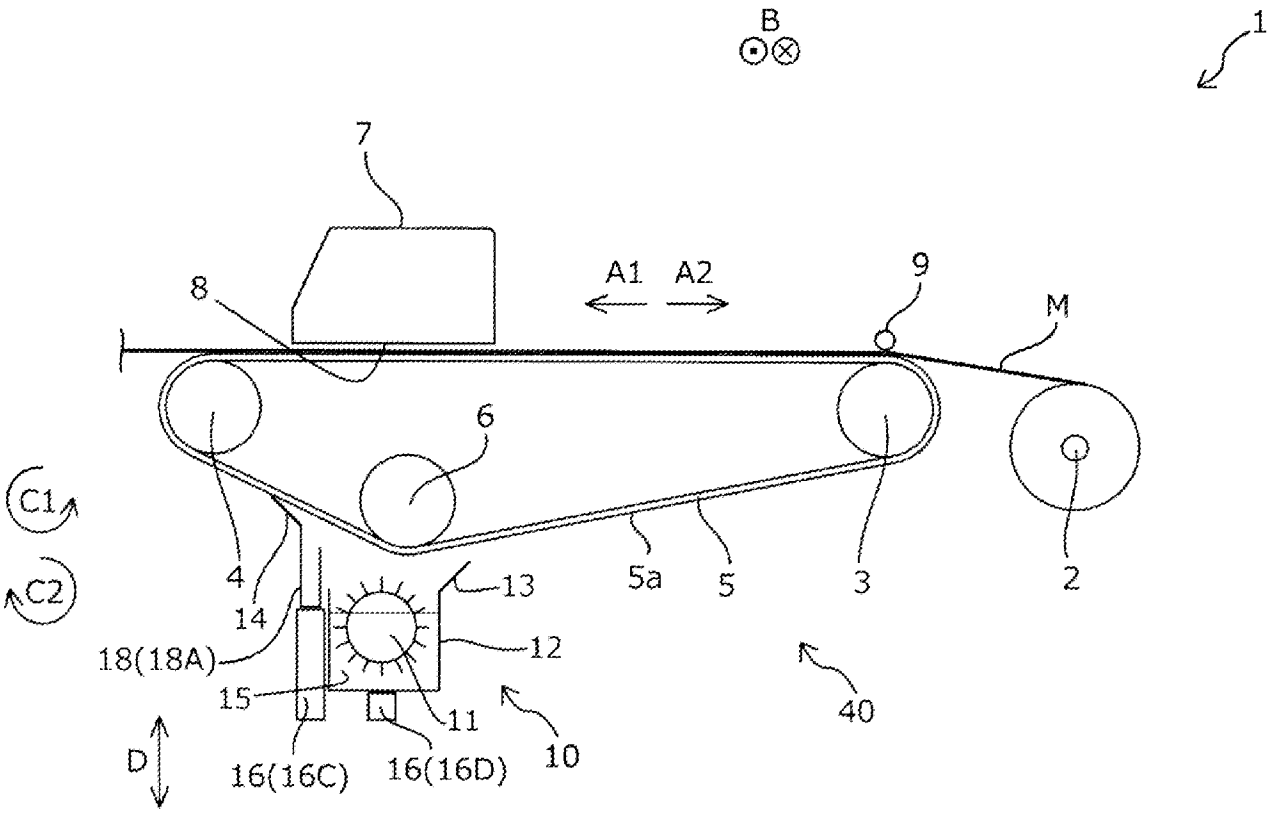
FIG. 7 is a schematic side view of the recording device according to Example 3 of the present disclosure, when transporting the recording medium in the reverse transport direction.

Next, the recording device 1 according to Example 3 will be described with reference to FIG. 6 and FIG. 7. FIG. 6 is a schematic side view illustrating the recording device 1 according to this example, and is a diagram corresponding to FIG. 1 relating to the recording device 1 according to Example 1. Further, FIG. 7 is a schematic side view illustrating the recording device 1 according to this example, and is a diagram corresponding to FIG. 2 relating to the recording device 1 according to Example 1. Here, the recording device 1 according to this example has the same configuration as that of the recording device 1 according to Example 1 and Example 2 except for the configuration of the cleaning unit 10. Thus, the recording device 1 according to this example has the same characteristics as those of the recording device 1 according to Example 1 and Example 2 except for characteristics to be described below, and a description of the common configurations will be omitted. Note that the constituent members common to those in Example 1 and Example 2 described above will be denoted by the same reference numerals, and a detailed description thereof will be omitted.

As described above, in the recording device 1 according to Example 1 and Example 2, the upstream blade 14 and the downstream blade 13 are both provided at the cleaning liquid tank 12. On the other hand, as illustrated in FIG. 6 and FIG. 7, the recording device 1 according to this example includes a storage unit 18 (a storage unit 18A) that can store the cleaning liquid 15, and although the downstream blade 13 is provided at the cleaning liquid tank 12, the upstream blade 14 is provided at the storage unit 18A. Further, as illustrated in FIG. 6 and FIG. 7, an air cylinder 16D that moves the cleaning liquid tank 12 along the vertical direction D is provided at the bottom surface portion of the cleaning liquid tank 12, and an air cylinder 16C that can move the cleaning liquid tank 12 along the vertical direction D is provided at a bottom surface portion of the storage unit 18A.

Then, in the recording device 1 according to this example, by extending and contracting the air cylinder 16C and the air cylinder 16D in the vertical direction D, the upstream blade 14 can be separated from the support face 5*a* while causing the downstream blade 13 to come into contact with the support face 5*a*, as illustrated in FIG. 6, and the upstream blade 14 can be brought into contact with the support face 5*a* while causing the downstream blade 13 to be separated from the support face 5*a*, as illustrated in FIG. 7. Note that, as in the recording device 1 according to Example 1 and Example 2, when the recording medium M is transported in the normal transport direction A1, the downstream blade 13 is brought into contact with the support face 5*a* and the upstream blade 14 is separated from the support face 5*a*, as illustrated in FIG. 6. On the other hand, as illustrated in FIG. 7, when the recording medium M is transported in the reverse transport direction A2, the downstream blade 13 is separated from the support face 5*a*, and the upstream blade 14 is brought into contact with the support face 5*a*.

In this way, the recording device 1 according to this example includes the storage unit 18A to which the upstream blade 14 is attached and which stores the cleaning liquid 15 removed from the support face 5*a* by the upstream blade 14, and the air cylinder 16C, which serves as the blade moving unit, moves the upstream blade 14 in the approaching and separating directions with respect to the support face 5*a* by moving the storage unit 18A. As described above, the recording device 1 according to this example includes the storage unit 18A to which the upstream blade 14 is attached and which stores the cleaning liquid 15 removed from the support face 5*a* by the upstream blade 14. Thus, the recording device 1 according to this example can inhibit the cleaning liquid 15 removed from the support face 5*a* of the transporting belt 5 by the upstream blade 14 from being dispersed inside the device and resulting in staining the device. Here, when removing the cleaning liquid 15, the storage unit 18A is preferably placed at a position close to the support face 5*a* so that the cleaning liquid 15 does not splash to the outside, and at other times when not removing the cleaning liquid 15, the storage unit 18A is preferably placed at a position far from the support face 5*a* so as not to obstruct the rotation of the transporting belt 5. Here, the recording device 1 according to this example is configured such that the air cylinder 16C moves the storage unit 18A to move the upstream blade 14 in the approaching and separating directions with respect to the support face 5*a* of the transporting belt 5. In this way, a movement mechanism of the storage unit 18A, the movement mechanism of the upstream blade 14, and a movement mechanism of the air cylinder 16C can be integrated as one mechanism, and thus the configuration of the device can be simplified.

Further, when describing this from another perspective, the downstream blade 13 is fixed to the cleaning liquid tank 12. Then, when the transporting belt 5 is reversely rotating as illustrated in FIG. 6, the air cylinder 16D moves the cleaning liquid tank 12 to cause the downstream blade 13 to be separated from the support face 5*a*, and when the transporting belt 5 is normally rotating as illustrated in FIG. 7, the air cylinder 16C causes the downstream blade 13 to come into contact with the support face 5*a*. Thus, when transporting the recording medium M in the normal transport direction A1, such as during the recording operation, before the cleaning liquid 15 reaches the recording medium M, the cleaning liquid 15 attached to the support face 5*a* of the transporting belt 5 by the rotary brush 11 can be removed using the downstream blade 13.

EXAMPLE 4

Figure 8:
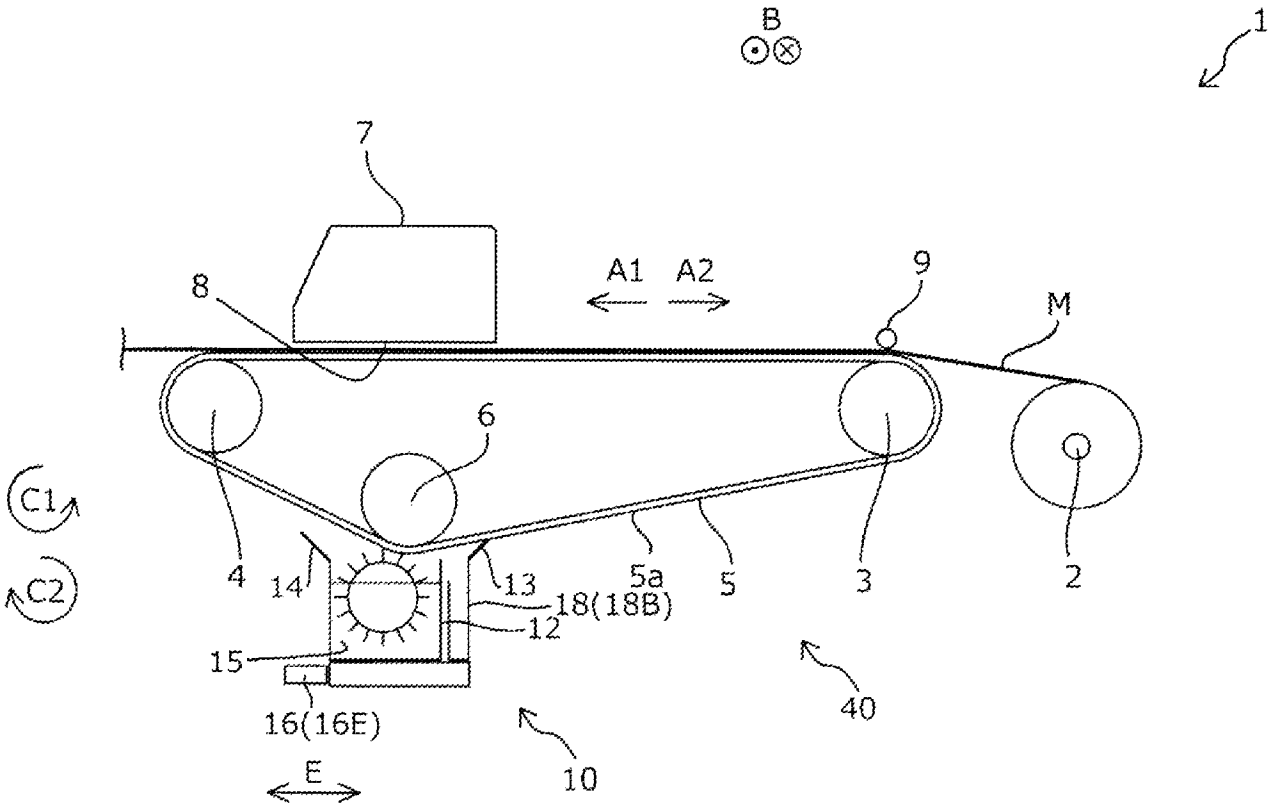
FIG. 8 is a schematic side view of the recording device according to Example 4 of the present disclosure, when transporting the recording medium in the normal transport direction.
Figure 9:
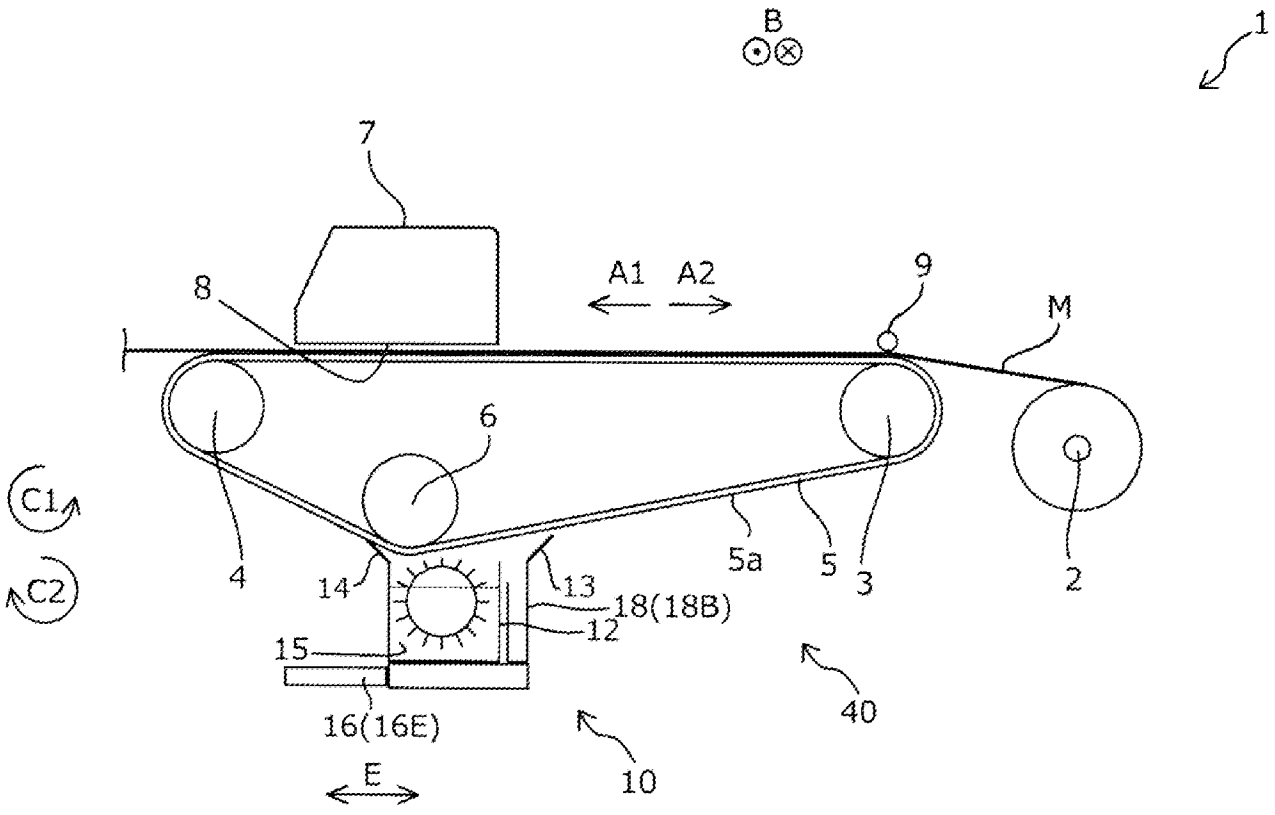
FIG. 9 is a schematic side view of the recording device according to Example 4 of the present disclosure, when transporting the recording medium in the reverse transport direction.

Next, the recording device 1 according to Example 4 will be described with reference to FIG. 8 and FIG. 9. FIG. 8 is a schematic side view illustrating the recording device 1 according to this example, and is a diagram corresponding to FIG. 1 relating to the recording device 1 according to Example 1. Further, FIG. 9 is a schematic side view illustrating the recording device 1 according to this example, and is a diagram corresponding to FIG. 2 relating to the recording device 1 according to Example 1. Here, the recording device 1 according to this example has the same configuration as that of the recording device 1 according to Example 1 to Example 3 except for the configuration of the cleaning unit 10. Thus, the recording device 1 according to this example has the same characteristics as those of the recording device 1 according to Example 1 to Example 3 except for those to be described below, and a description of the common configurations will be omitted. Note that the constituent members common to those in Example 1 to Example 3 described above will be denoted by the same reference numerals, and a detailed description thereof will be omitted.

As described above, in the recording device 1 according to Example 3, the downstream blade 13 is provided at the cleaning liquid tank 12, and the upstream blade 14 is provided at the storage unit 18A. On the other hand, as illustrated in FIG. 8 and FIG. 9, the recording device 1 according to this example includes a storage unit 18B as the storage unit 18, the downstream blade 13 is provided at the storage unit 18B, and the upstream blade 14 is provided at the cleaning liquid tank 12. Further, as illustrated in FIG. 8 and FIG. 9, the recording device 1 according to this example includes an air cylinder 16E that can move the cleaning liquid tank 12 and the storage unit 18B along a horizontal direction E.

Then, in the recording device 1 according to this example, by extending and contracting the air cylinder 16E in the horizontal direction E, the upstream blade 14 can be separated from the support face 5*a* while causing the downstream blade 13 to come into contact with the support face 5*a*, as illustrated in FIG. 8, and the upstream blade 14 can be brought into contact with the support face 5*a* while causing the downstream blade 13 to be separated from the support face 5*a*, as illustrated in FIG. 9. Note that, as in the recording device 1 according to Example 1 to Example 3, when the recording medium M is transported in the normal transport direction A1, the downstream blade 13 is brought into contact with the support face 5*a* and the upstream blade 14 is separated from the support face 5*a*, as illustrated in FIG. 8. On the other hand, when the recording medium M is transported in the reverse transport direction A2, the downstream blade 13 is separated from the support face 5*a* and the upstream blade 14 is brought into contact with the support face 5*a*, as illustrated in FIG. 9.

EXAMPLE 5

Figure 10:
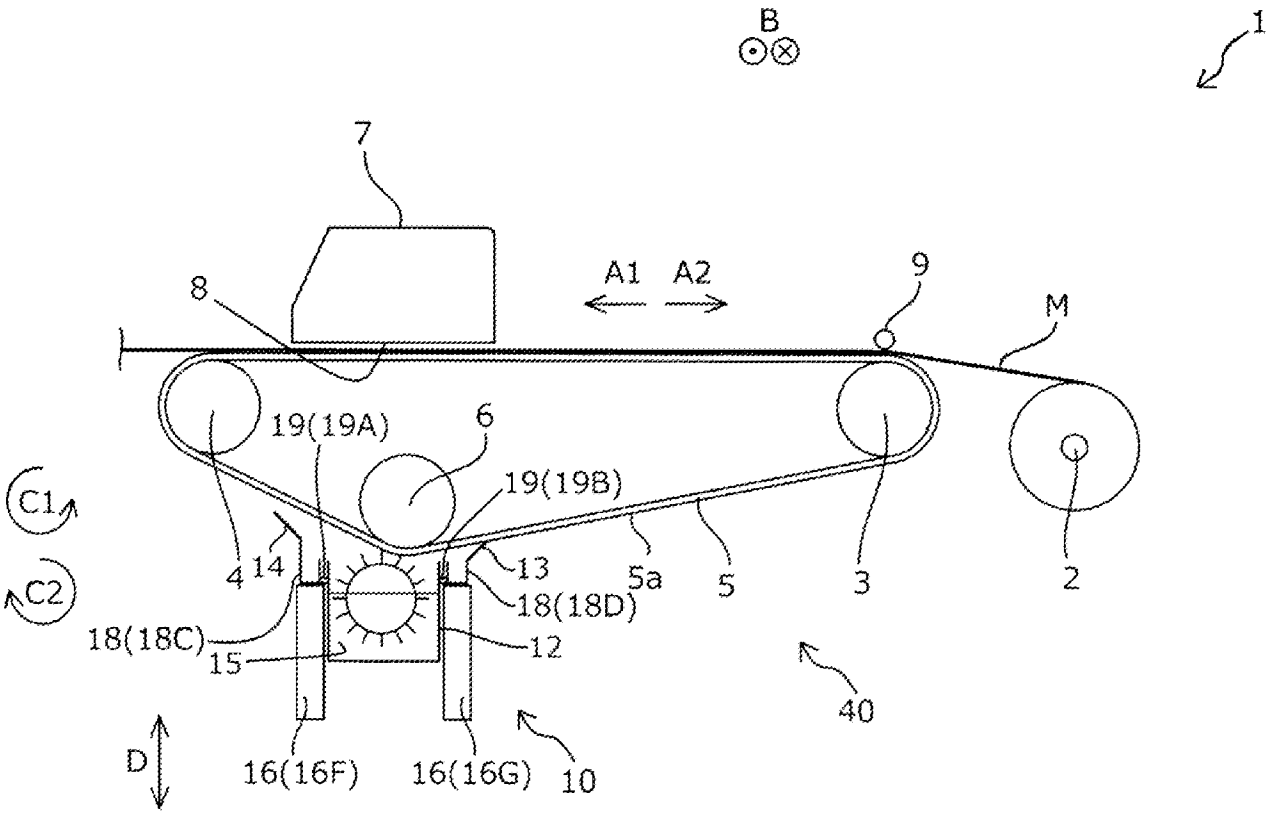
FIG. 10 is a schematic side view of the recording device according to Example 5 of the present disclosure, when transporting the recording medium in the normal transport direction.
Figure 11:
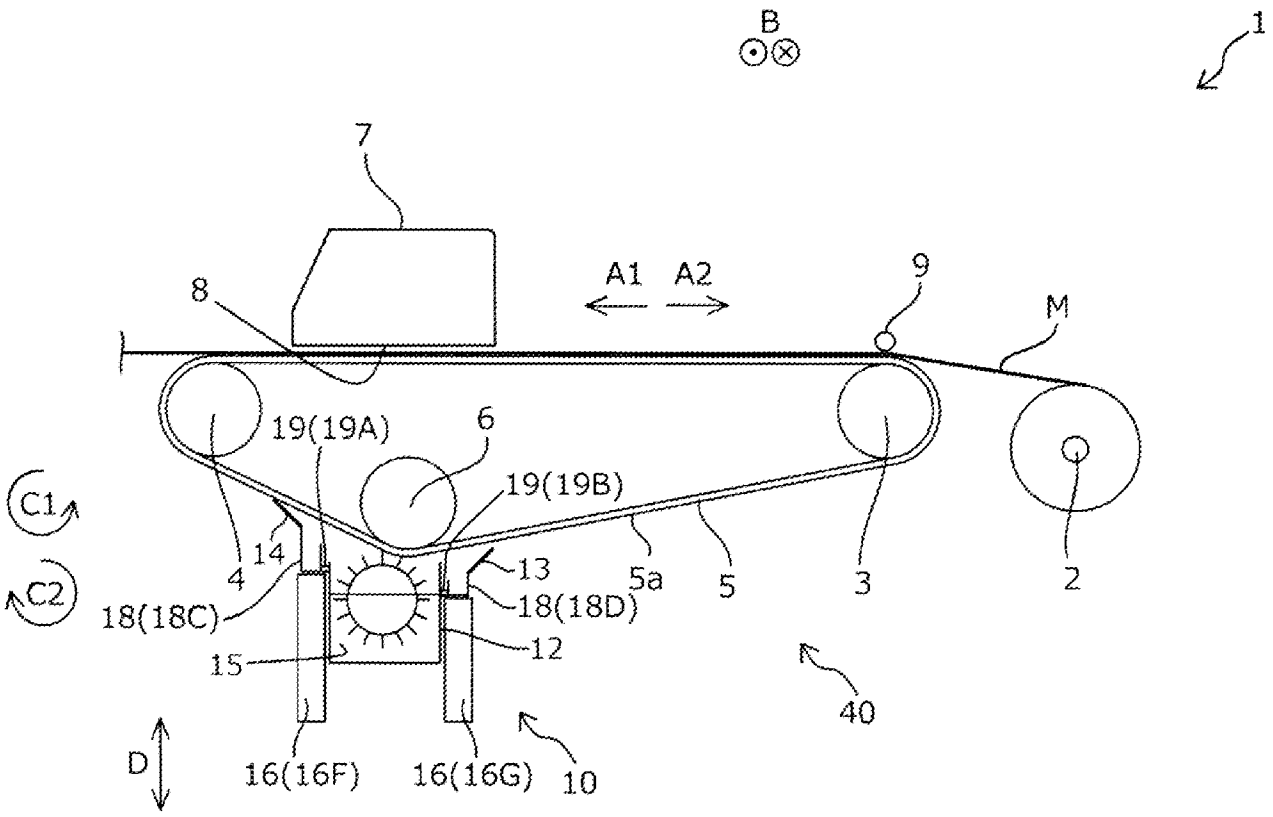
FIG. 11 is a schematic side view of the recording device according to Example 5 of the present disclosure, when transporting the recording medium in the reverse transport direction.

Next, the recording device 1 according to Example 5 will be described with reference to FIG. 10 and FIG. 11. FIG. 10 is a schematic side view illustrating the recording device 1 according to this example, and is a diagram corresponding to FIG. 1 relating to the recording device 1 according to Example 1. Further, FIG. 11 is a schematic side view illustrating the recording device 1 according to this example, and is a diagram corresponding to FIG. 2 relating to the recording device 1 according to Example 1. Here, the recording device 1 according to this example has the same configuration as that of the recording device 1 according to Example 1 to Example 4 except for the configuration of the cleaning unit 10. Thus, the recording device 1 according to this example has the same characteristics as those of the recording device 1 according to Example 1 to Example 4 except for those to be described below, and a description of the common configurations will be omitted. Note that the constituent members common to those in Example 1 to Example 4 described above will be denoted by the same reference numerals, and a detailed description thereof will be omitted.

As described above, the recording device 1 according to Example 3 and Example 4 includes the single storage unit 18, one of the downstream blade 13 and the upstream blade 14 is provided at the cleaning liquid tank 12, and the other of the downstream blade 13 and the upstream blade 14 is provided at the storage unit 18. On the other hand, as illustrated in FIG. 10 and FIG. 11, the recording device 1 according to this example includes a storage unit 18C and a storage unit 18D as the storage units 18, the downstream blade 13 is provided at the storage unit 18D, and the upstream blade 14 is provided at the storage unit 18C. Further, as illustrated in FIG. 10 and FIG. 11, in the recording device 1 according to this example, an air cylinder 16F that can move the storage unit 18C along the vertical direction D is provided at a bottom surface portion of the storage unit 18C, and an air cylinder 16G that can move the storage unit 18D along the vertical direction D is provided at a bottom surface portion of the storage unit 18C.

Then, in the recording device 1 according to this example, by extending and contracting the air cylinder 16F and the air cylinder 16G in the vertical direction D, the upstream blade 14 can be separated from the support face 5*a* while causing the downstream blade 13 to come into contact with the support face 5*a*, as illustrated in FIG. 10, and the upstream blade 14 can be brought into contact with the support face 5*a* while causing the downstream blade 13 to be separated from the support face 5*a*, as illustrated in FIG. 11. Note that, as in the recording device 1 according to Example 1 to Example 4, when the recording medium M is transported in the normal transport direction A1, the downstream blade 13 is brought into contact with the support face 5*a* and the upstream blade 14 is separated from the support face 5*a*, as illustrated in FIG. 10. On the other hand, when the recording medium M is transported in the reverse transport direction A2, the downstream blade 13 is separated from the support face 5*a* and the upstream blade 14 is brought into contact with the support face 5*a*, as illustrated in FIG. 11.

Further, as illustrated in FIG. 10 and FIG. 11, the recording device 1 according to this example includes flow paths 19, of the cleaning liquid 15, that connect the storage units 18 to the cleaning liquid tank 12. In more detail, the recording device 1 according to this example includes a flow path 19A, of the cleaning liquid 15, that connects the storage unit 18C to the cleaning liquid tank 12 to allow the cleaning liquid 15 accumulated in the storage unit 18C to return to the cleaning liquid tank 12, and a flow path 19B, of the cleaning liquid 15, that connects the storage unit 18D to the cleaning liquid tank 12 to allow the cleaning liquid 15 accumulated in the storage unit 18D to return to the cleaning liquid tank 12. In this way, the recording device 1 according to this example includes the flow paths 19, of the cleaning liquid 15, that connect the storage units 18 to the cleaning liquid tank 12. Thus, the cleaning liquid 15 can be repeatedly used, and wasteful use of the cleaning liquid 15 can be suppressed. Note that the flow path 19 as provided in this example may be applied to the recording device 1 according to Example 3 and Example 4.

EXAMPLE 6

Figure 12:
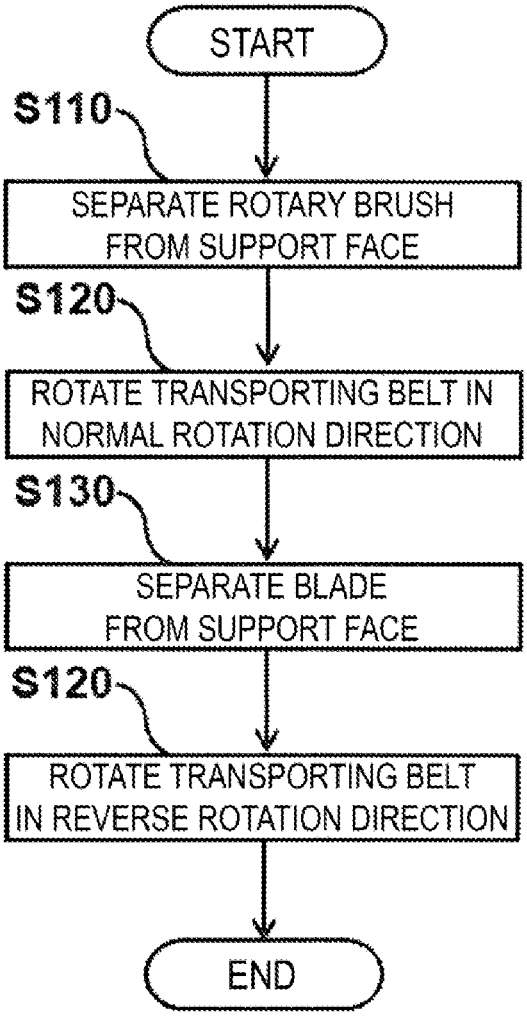
FIG. 12 is a flowchart of a method for reversely transporting the recording medium, using the recording device according to Example 6 of the present disclosure.
Figure 13:
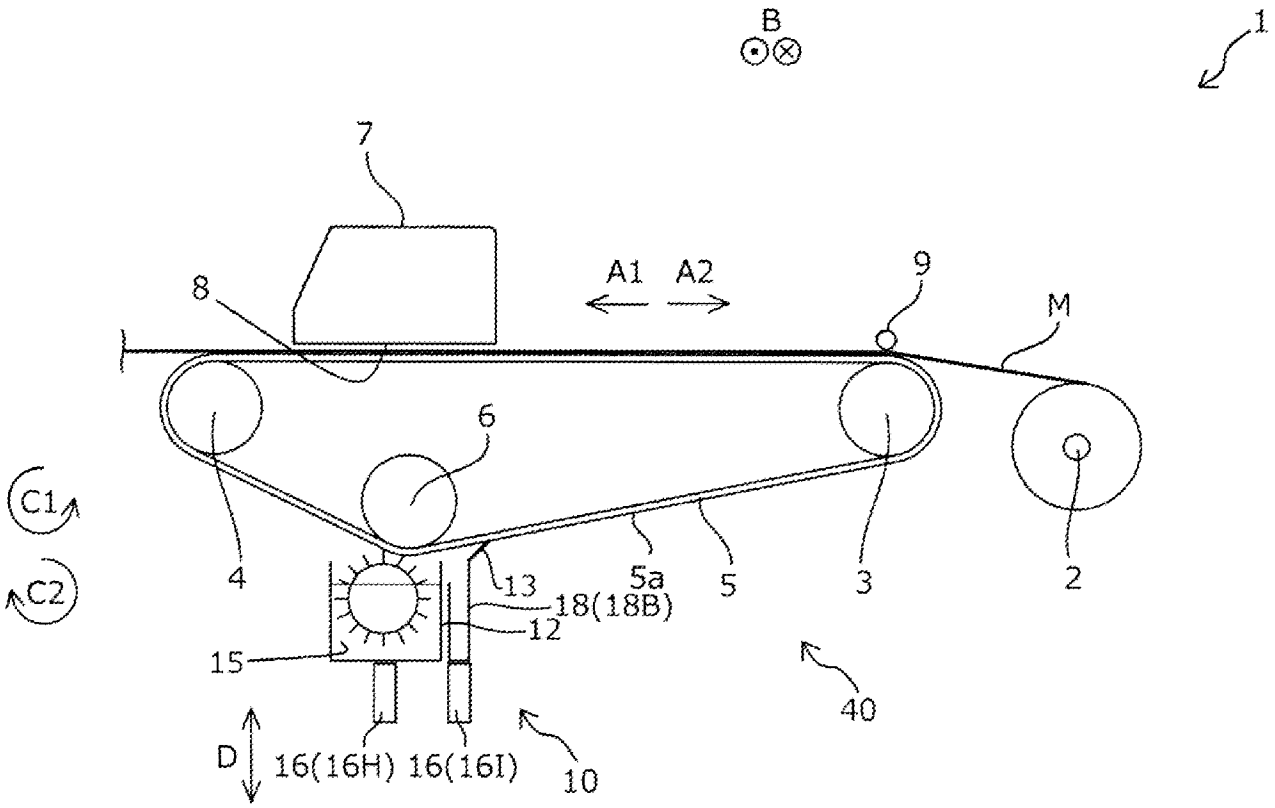
FIG. 13 is a schematic side view of the recording device according to Example 6 of the present disclosure, when transporting the recording medium in the normal transport direction before transporting the recording medium in the reverse transport direction.
Figure 14:
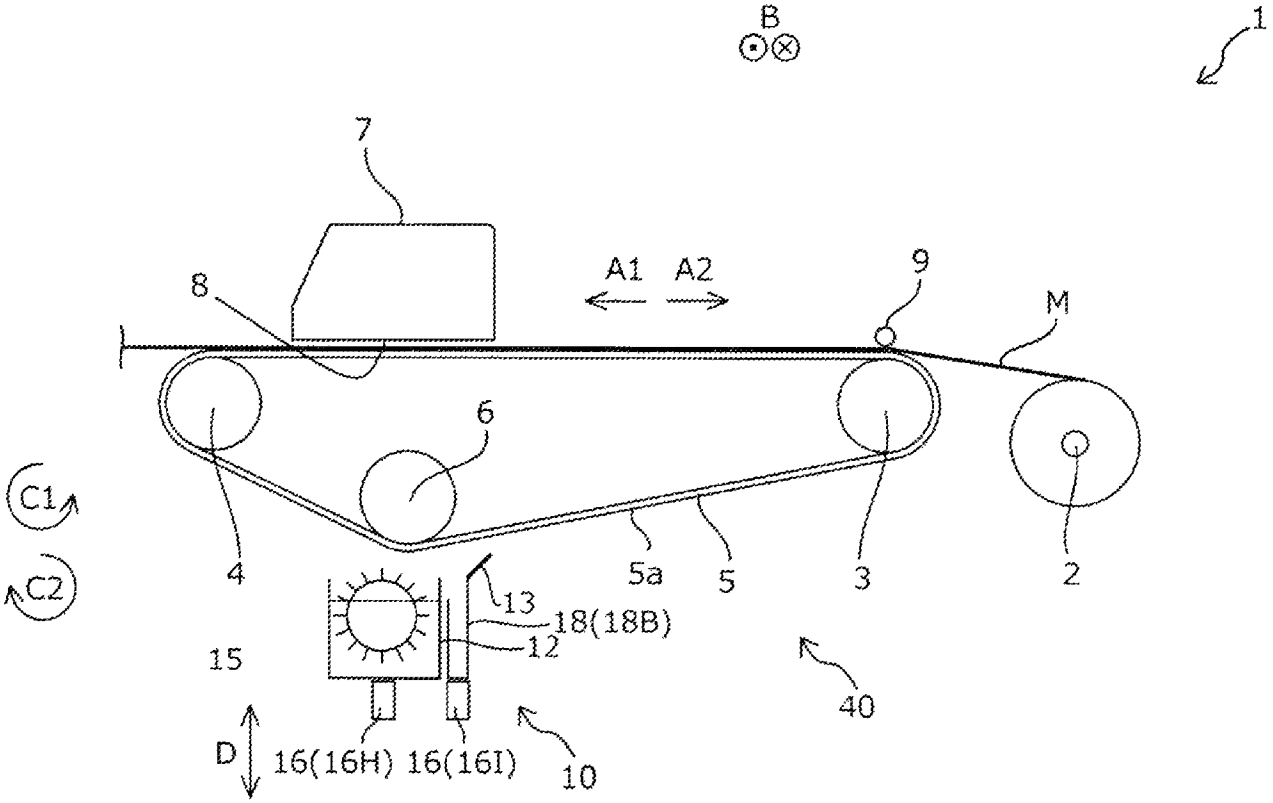
FIG. 14 is a schematic side view of the recording device according to Example 6 of the present disclosure, when transporting the recording medium in the reverse transport direction.

Next, the recording device 1 according to Example 6 will be described with reference to FIG. 12 to FIG. 14. Of these, FIG. 13 is a schematic side view illustrating the recording device 1 according to this example, and is a diagram corresponding to FIG. 1 relating to the recording device 1 according to Example 1. Further, FIG. 14 is a schematic side view illustrating the recording device 1 according to this example, and is a diagram corresponding to FIG. 2 relating to the recording device 1 according to Example 1. Here, the recording device 1 according to this example has the same configuration as that of the recording device 1 according to Example 1 to Example 5 except for the configuration of the cleaning unit 10. Thus, the recording device 1 according to this example has the same characteristics as those of the recording device 1 according to Example 1 to Example 5 except for those to be described below, and a description of the common configurations will be omitted. Note that the constituent members common to those in Example 1 to Example 5 described above will be denoted by the same reference numerals, and a detailed description thereof will be omitted.

As described above, in the recording device 1 according to Examples 1 to 5, the upstream blade 14 is provided in addition to the downstream blade 13. On the other hand, as illustrated in FIG. 13 and FIG. 14, the recording device 1 according to this example includes the downstream blade 13, but does not include the upstream blade 14. In this way, the recording device 1 according to this example does not include the upstream blade 14. Thus, the recording device 1 according to this example reversely transports the recording medium based on a flowchart illustrated in FIG. 12.

Specifically, when a method for reversely transporting the recording medium is performed using the recording device 1 according to this example, first, at step S110, from a state illustrated in FIG. 13, an air cylinder 16H is contracted in the vertical direction D to separate the rotary brush 11 from the support face 5*a*. Note that at this time, an air cylinder 16I is maintained to be in an extended state.

Next, at step S120, the transporting belt 5 is normally rotated in the normal rotation direction C1. Here, at this step, the transporting belt 5 is moved by an amount sufficient to move a region, of the support face 5*a*, with which the rotary brush 11 has come into contact at step S110, at least beyond the downstream blade 13. Note that since the air cylinder 16I is maintained to be in the extended state, the transporting belt 5 is normally rotated while the downstream blade 13 is in contact with the support face 5*a*.

Next, at step S130, as illustrated in FIG. 14, the air cylinder 16I is contracted in the vertical direction D to separate the downstream blade 13 from the support face 5*a*. Note that at this time, the rotary brush 11 is maintained to be separated from the support face 5*a*.

Next, at step S140, the transporting belt 5 is reversely rotated while maintaining a state in which the downstream blade 13 and the rotary brush 11 are separated from the support face 5*a*, as illustrated in FIG. 14, in order to reversely transport the recording medium by a desired amount. Then, at the end of this step, the method for reversely transporting the recording medium according to this example ends. Note that before reversely rotating the transporting belt 5, a step of wiping the region, of the support face 5*a*, with which the downstream blade 13 has come into contact may be performed.

As in the recording device 1 according to Example 1, the recording device 1 according to this example includes the control unit 20, and the control unit 20 controls the normal rotation and the reverse rotation of the transporting belt 5, and the movement of the rotary brush 11 and the downstream blade 13 in the approaching and separating directions with respect to the support face 5*a*. Then, when reversely rotating the transporting belt 5, as described at step S110, the control unit 20 first positions the rotary brush 11 in a non-contact position in which the rotary brush 11 does not come into contact with the support face 5*a*. Then, as described at step S120, while the downstream blade 13 is in contact with the support face 5*a*, the transporting belt 5 is normally rotated until the region, of the support face 5*a*, with which the rotary brush 11 has come into contact is moved beyond the downstream blade 13. Then, as described at step S130, the downstream blade 13 is separated from the support face 5*a*. Then, as described at step S140, the transporting belt 5 is reversely rotated in a state in which the downstream blade 13 is separated from the support face 5*a*. By performing such an operation under the control of the control unit 20, the recording device 1 according to this example can inhibit the cleaning liquid 15 from adhering to the recording medium M when reversely transporting the recording medium M.

When describing the above in other words from the perspective of the method for reversely transporting the recording medium, by performing the method for reversely transporting the recording medium, in which each of the following steps is performed, using the recording device 1 according to this example, the recording device 1 can inhibit the cleaning liquid 15 from adhering to the recording medium M when reversely transporting the recording medium M. Specifically, first, as described at step S110, a step of positioning the rotary brush 11 in the non-contact position is performed. Next, as described at step S120, a step of normally rotating the transporting belt 5 until the region, of the support face 5*a*, with which the rotary brush 11 has come into contact is moved beyond the downstream blade 13, while the downstream blade 13 is in contact with the support face 5*a* is performed. Next, as described at step S130, a step of separating the downstream blade 13 from the support face 5*a* is performed. Then, as described at step S140, a step of reversely rotating the transporting belt 5 in the state in which the downstream blade 13 is separated from the support face 5*a* is performed.

Note that the present disclosure is not limited to the above-described examples, and many variations are possible within the scope of the disclosure as described in the appended claims. It goes without saying that such variations also fall within the scope of the present disclosure.

What is claimed is:

1. A recording device comprising:

a plurality of rollers configured to rotate in a normal rotation direction and a reverse rotation direction opposite to the normal rotation direction;

a transporting belt that is endless and stretched across the plurality of rollers, the transporting belt being configured to rotate in the normal rotation direction, by rotation of the plurality of rollers in the normal rotation direction, to transport a recording medium placed in a placement range of a front surface of the transporting belt in a normal transport direction, and to rotate in the reverse rotation direction, by rotation of the plurality of rollers in the reverse rotation direction, to transport the recording medium placed in the placement range in a reverse transport direction;

a recording head configured to eject ink onto the recording medium placed on the transporting belt to perform recording;

a cleaning liquid attaching unit configured to attach a cleaning liquid to the front surface at a position downstream in the normal transport direction of a position, outside the placement range, where the recording medium is peeled from the front surface;

a first blade configured to come into contact with the front surface to remove the cleaning liquid attached to the front surface by the cleaning liquid attaching unit; and a blade moving unit configured to move the first blade in approaching and separating directions with respect to the front surface, which are directions approaching and moving away from the front surface, wherein the recording head, the first blade, and the cleaning liquid attaching unit are arranged in this order from upstream in the normal transport direction of the transporting belt, and the blade moving unit causes the first blade to come into contact with the front surface when the transporting belt is rotating in the reverse rotation direction, and causes the first blade to be separated from the front surface when the transporting belt is rotating in the normal rotation direction.

2. The recording device according to claim 1, wherein the cleaning liquid attaching unit includes a cleaning liquid tank storing the cleaning liquid, and a rotary brush rotating in a state in which a portion thereof is immersed in the cleaning liquid while being in contact with the front surface, the first blade is fixed to the cleaning liquid tank, and the blade moving unit moves the first blade in the approaching and separating directions with respect to the front surface by moving the cleaning liquid tank.

3. The recording device according to claim 1, comprising:

a second blade configured to come into contact with the front surface to remove the cleaning liquid attached to the front surface by the cleaning liquid attaching unit, wherein the blade moving unit is configured to move the second blade in the approaching and separating directions with respect to the front surface, the recording head, the first blade, the cleaning liquid attaching unit, and the second blade are arranged in this order from upstream in the normal transport direction of the transporting belt, and the blade moving unit causes the second blade to be separated from the front surface when the transporting belt is rotating in the reverse rotation direction, and causes the second blade to come into contact with the front surface when the transporting belt is rotating in the normal rotation direction.

4. The recording device according to claim 2, comprising:

a second blade configured to come into contact with the front surface to remove the cleaning liquid attached to the front surface by the cleaning liquid attaching unit, wherein the second blade is fixed to the cleaning liquid tank, the blade moving unit is configured to move the second blade in the approaching and separating directions with respect to the front surface by moving the cleaning liquid tank, the recording head, the first blade, the cleaning liquid attaching unit, and the second blade are arranged in this order from upstream in the normal transport direction of the transporting belt, and the blade moving unit causes the second blade to be separated from the front surface when the transporting belt is rotating in the reverse rotation direction, and causes the second blade to come into contact with the front surface when the transporting belt is rotating in the normal rotation direction.

5. The recording device according to claim 2, wherein the blade moving unit moves the first blade in the approaching and separating directions with respect to the front surface by inclining the cleaning liquid tank as viewed from a rotation axis direction of the plurality of rollers.

6. The recording device according to claim 3, comprising:

a storage unit to which the first blade is attached and configured to store the cleaning liquid removed from the front surface by the first blade, wherein the blade moving unit moves the first blade in the approaching and separating directions with respect to the front surface by moving the storage unit.

7. The recording device according to claim 6, wherein the cleaning liquid attaching unit includes a cleaning liquid tank storing the cleaning liquid, and a rotary brush rotating in a state in which a portion thereof is immersed in the cleaning liquid while being in contact with the front surface, the second blade is fixed to the cleaning liquid tank, and by moving the cleaning liquid tank, the blade moving unit causes the second blade to be separated from the front surface when the transporting belt is rotating in the reverse rotation direction, and causes the second blade to come into contact with the front surface when the transporting belt is rotating in the normal rotation direction.

8. The recording device according to claim 6, wherein the cleaning liquid attaching unit includes a cleaning liquid tank storing the cleaning liquid, and a rotary brush rotating in a state in which a portion thereof is immersed in the cleaning liquid while being in contact with the front surface, and a flow path, of the cleaning liquid, that connects the storage unit to the cleaning liquid tank is provided.

* * * * *